US008407943B2

(12) United States Patent
Sudkamp et al.

(10) Patent No.: US 8,407,943 B2
(45) Date of Patent: Apr. 2, 2013

(54) BLEACHER SEATING SYSTEM

(75) Inventors: Joe B. Sudkamp, Shumway, IL (US); Steven R. Madden, Altamont, IL (US); Mark N. Middleton, Kinmundy, IL (US)

(73) Assignee: Irwin Seating Company, Grand Rapids, MI (US)

( * ) Notice: Subject to any disclaimer, the term of this patent is extended or adjusted under 35 U.S.C. 154(b) by 114 days.

(21) Appl. No.: 12/913,207

(22) Filed: Oct. 27, 2010

(65) Prior Publication Data

US 2011/0099915 A1 May 5, 2011

Related U.S. Application Data

(60) Provisional application No. 61/256,672, filed on Oct. 30, 2009.

(51) Int. Cl.
*E04H 3/12* (2006.01)

(52) U.S. Cl. ..... 52/10; 52/9; 52/126.1; 182/223

(58) Field of Classification Search ..... 52/9, 8, 52/10, 126.1, 6, 7, 109; 254/93 R, 134; 472/92; 182/132, 223
See application file for complete search history.

(56) References Cited

U.S. PATENT DOCUMENTS 2,706,835 A * 4/1955 Ullom ..... 52/9
2,888,182 A 5/1959 Nixon
2,931,519 A * 4/1960 Beach ..... 414/589
3,195,860 A * 7/1965 Simms ..... 254/2 B
3,389,511 A * 6/1968 Drehobl ..... 52/9
3,400,502 A 9/1968 Scaggs et al.
3,608,251 A 9/1971 Scaggs
3,991,857 A * 11/1976 Wolk et al. ..... 187/269
4,041,655 A * 8/1977 Pari ..... 52/9
4,063,392 A 12/1977 Van Ryn et al.
RE29,635 E * 5/1978 McClelland et al. ..... 52/9
4,155,202 A 5/1979 Hartman
4,361,991 A 12/1982 Wiese
4,403,680 A * 9/1983 Hillesheimer ..... 177/146
4,467,569 A 8/1984 Blanchard et al.
4,526,346 A * 7/1985 Galloway et al. ..... 254/122
4,571,895 A 2/1986 Lyman, Jr.
4,858,888 A * 8/1989 Cruz et al. ..... 254/122
4,995,130 A * 2/1991 Hahn et al. ..... 14/71.3
5,069,007 A 12/1991 Paddock
5,287,804 A * 2/1994 Compagnone ..... 108/147
(Continued)

FOREIGN PATENT DOCUMENTS

JP 02047471 A * 2/1990
JP 03021775 1/1991
(Continued)

*Primary Examiner* — William Gilbert
*Assistant Examiner* — Babajide Demuren
(74) *Attorney, Agent, or Firm* — Gardner, Linn, Burkhart & Flory, LLP

(57) ABSTRACT

A bleacher seating system provides a compact, automatically extending and retracting set of seating rows, where each seating row can be set at two or more different heights or slopes to provide different sightlines for spectators of different events. The bleacher seating system may be extended, retracted, raised, and lowered by a single operator, and may be retracted into a compact storage configuration, such as a configuration that is only about two seating rows in depth. The seating rows are independently raised and lowered by lift mechanisms, which include lock mechanisms to stabilize and lock each seating row at the different preselected heights. Optionally, a controller is provided for coordinating the powered extension, retraction, raising, lowering, and locking sequences of the seating system.

34 Claims, 20 Drawing Sheets

U.S. PATENT DOCUMENTS

| | | | | |
|---|---|---|---|---|
| 5,322,143 | A * | 6/1994 | Curran | 187/211 |
| 5,375,962 | A | 12/1994 | Kempf | |
| 5,517,789 | A | 5/1996 | Sugiyama | |
| 5,559,411 | A | 9/1996 | Winship | |
| 5,653,502 | A | 8/1997 | Kimura et al. | |
| 5,820,110 | A | 10/1998 | Beu | |
| 5,913,776 | A | 6/1999 | Compagnone | |
| 5,921,031 | A | 7/1999 | Williams | |
| 6,003,270 | A | 12/1999 | MacIntyre | |
| 6,029,406 | A | 2/2000 | Staehlin | |
| 6,050,366 | A | 4/2000 | Lyons | |
| 6,185,875 | B1 | 2/2001 | Victor et al. | |
| 6,199,325 | B1 | 3/2001 | Winship | |
| 6,212,828 | B1 | 4/2001 | McArthur, Jr. | |
| 6,243,991 | B1 | 6/2001 | Iritani | |
| 6,244,657 | B1 | 6/2001 | Momose | |
| 6,298,801 | B1 | 10/2001 | May | |
| 6,324,790 | B1 | 12/2001 | Victor et al. | |
| 6,502,893 | B1 | 1/2003 | Corliss, Jr. | |
| 6,539,672 | B1 | 4/2003 | Frost | |
| 1,619,678 | A1 | 5/2003 | Prinz | |
| 6,615,548 | B1 | 9/2003 | Nakamura et al. | |
| 6,625,932 | B1 | 9/2003 | Littlefield | |
| 6,925,760 | B2 * | 8/2005 | Suprina | 52/9 |
| 7,337,583 | B1 | 3/2008 | Lohman et al. | |
| 7,617,635 | B2 | 11/2009 | Jacobs et al. | |
| 2003/0200703 | A1 * | 10/2003 | Suprina | 52/9 |
| 2008/0083170 | A1 * | 4/2008 | Staten et al. | 52/10 |
| 2008/0190038 | A1 * | 8/2008 | Jacobs et al. | 52/9 |
| 2010/0192477 | A1 | 8/2010 | Wisner et al. | |

FOREIGN PATENT DOCUMENTS

| | | |
|---|---|---|
| WO | WO 9425706 A1 * | 11/1994 |

* cited by examiner

XIA
XIB
XIC
56
58
62
66
66a
68
68a
68b
70
74
76
97

BLEACHER SEATING SYSTEM

CROSS REFERENCE TO RELATED APPLICATION

The present application claims the priority benefit of U.S. provisional application Ser. No. 61/256,672, filed Oct. 30, 2009, which is hereby incorporated herein by reference in its entirety.

FIELD OF THE INVENTION

The present invention relates to bleacher seating systems that are extendable and retractable according to the needs of a facility in which the bleachers are installed.

BACKGROUND OF THE INVENTION

Sporting and exhibition venues or facilities often include bleacher-style seating systems to provide spectators with unobstructed views of a sporting event or other activity taking place at the venue. Indoor venues in particular, such as gymnasiums, stadiums, arenas and the like, are often used for different types of events, such that it may be desirable to provide a collapsible bleacher system that at least partially retracts against or into a wall or perimeter region of the venue. Additionally, certain types of events call for different types or configurations of bleacher seating such as, for example, a relatively steep slope for the spectators of a hockey game, and a relatively shallow slope for the spectators of a basketball game.

SUMMARY OF THE INVENTION

The present invention provides a bleacher seating system that is extendable and retractable between a collapsed or retracted state where the system is collapsed into a stacked or nested configuration, and an extended state, where the system is extended for use and is adaptable to different applications, such as by adjusting the slope or incline of the seating and decks of the bleacher seating system. The bleacher seating system includes a telescopically collapsible or retractable framework and a lift system capable of raising and lowering individual rows of seating to two or more different preselected heights, and locking the rows in place to provide stable seating platforms.

According to an aspect of the present invention, a bleacher seating system includes a plurality of deck portions, a lift mechanism and a lock mechanism. Each of the deck portions supports one or more seats. The deck portions are movable relative to one another between a nested configuration in which the deck portions are arranged above or below one another, and an extended position in which a lower deck portion is extended outward from an upper deck portion so that the deck portions are arranged in a stepped manner. The lift mechanism supports a respective one of the deck portions at a support surface in an adjustable manner. The lift mechanism is operable to selectively raise and lower its respective deck portion between a first position and a second position relative to the support surface. The lock mechanism limits lowering of a respective one of the deck portions when the deck portion is positioned at one of the first and second positions. The lock mechanism engages a portion of the lift mechanism to mechanically limit or preclude lowering of the deck portion once the deck portion is moved to one of the first and second positions. Thus, the deck portions of the bleacher seating system are positionable and lockable at one or more different heights above a stowed or fully-lowered configuration, and at least some of the deck portions may be positionable and lockable at two or more difference heights above the stowed or fully-lowered configuration. Optionally, one of the first and second positions corresponds to the stowed or fully-lowered configuration.

According to another aspect of the present invention, a bleacher seating system includes at least two deck portions, each of which is configured to support one or more seats. Each deck portion is supported by a corresponding deck frame, which in turn is supported by a corresponding lift mechanism at a corresponding support frame, with the lift mechanisms coupled between the deck frames and support frames. The two lift mechanisms are configured to independently and selectively raise and lower their respective deck frames relative to the respective support frames. A first of the two deck portions is positioned at an elevation below the support frame of the support frame corresponding to a second of the deck portions so that the first row of seating, including its lift mechanism, support frame, deck frame and deck portion, can be positioned directly below the second seating row during storage.

According to yet another aspect of the present invention, a method is provided for extending and retracting a telescopic bleacher seating system. The method includes providing at least two rows of seating, each row including a deck portion, a support frame, a lift mechanism coupled between the deck portion and the support frame, a base frame spaced below the support frame, and a support member or post coupled between the base frame and the support frame. One of the rows of seating is positioned substantially directly below the support frame of a second of the at least two rows of seating. The method further includes positioning the first of the seating rows in front of the second seating rows, actuating each of the lift mechanisms of the at least two rows of seating to raise their respective deck portions to a desired one of at least two selectable heights. The lift mechanisms include lock mechanisms that are then actuated into a locking configuration to prevent movement of the deck portions below the desired heights. The lock mechanisms may then be actuated to an unlocked configuration, and the lift mechanisms of the at least two rows of seating may be actuated to lower the deck portions at least until the deck portion of the first of the at least two rows of seating is positioned at an elevation below the support frame of the second of the at least two rows of seating. The first seating row may then be positioned directly below the support frame of the second seating row.

Optionally, a controller is provided to automatically actuate the lift mechanisms and to extend and retract the rows of seating in response to user inputs at the controller. For example, a single user input may cause the controller to raise and/or lower, and to lock and/or unlock the lift mechanisms to set or configure the seating system in any of two or more selectable heights or slopes, and another single user input may cause the controller to fully extend or retract the rows of seating.

Therefore, the present invention provides for extension and retraction of a collapsible or telescopic bleacher seating system between a retracted or compact storage configuration, with each of the rows or sections of seating positioned directly below a next-higher row or section of seating, and an extended or use configuration that provides seating for spectators of an event. When the seating system is extended, each of the rows of seating may be adjustably and selectively positioned at one of two or more different heights, such as to permit the seating system or configuration to be set at one or more different slopes to suit the changing needs of the facility in which the seating system is installed. The heights of the seating rows are adjusted via lift mechanisms, which include lock mechanisms that stabilize the seating system at the selected positions or heights, and prevent inadvertent lowering or collapse of the seating system.

These and other objects, advantages, purposes and features of the present invention will become apparent upon review of the following specification in conjunction with the drawings.

DESCRIPTION OF THE PREFERRED EMBODIMENTS

Figure 1A:
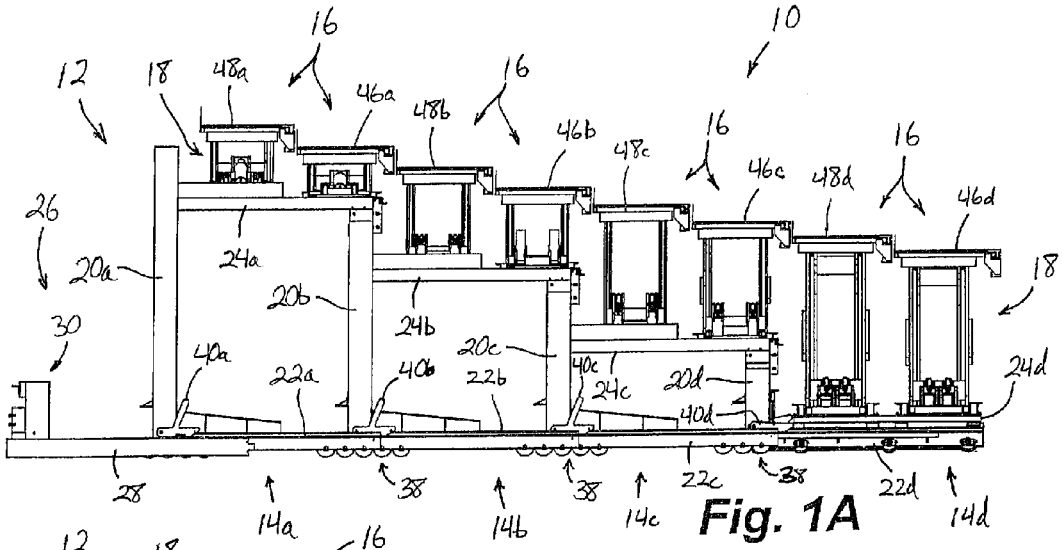
FIG. 1A is a side elevation of a bleacher seating system in accordance with the present invention, shown with the system in an extended configuration and with the seating arrangement in a shallow-slope configuration.

Referring now to the drawings and the illustrative embodiments depicted therein, a bleacher seating system 10 includes a telescopic framework 12 having a plurality of frame or seating sections 14*a-d* (FIGS. 1A-D, 4, 5 and 7). In the illustrated embodiment, each of the seating sections 14*a-d* includes a pair of independently-raisable seating rows 16, each of which includes a lift mechanism 18 and is capable of supporting spectator seating such as foldable or collapsible chairs or benches (not shown). Telescopic framework 12 is extendable and retractable along a generally horizontal support surface, such as a gymnasium or stadium or arena floor, with each of the frame sections 14*b-d* extending or projecting outwardly from a respective one of the adjacent frame sections 14*a-c*. Each lift mechanism 18 can be lowered sufficiently to permit each seating row 16 of a given frame section to fit entirely below the next-larger frame section without interference, such that each of the frame sections 14*b-d* may, when the lift mechanisms are lowered, nest within the next-larger frame section 14*a-c*, such as shown in FIGS. 5A-7. In addition, each lift mechanism 18 is capable of positioning and locking or mechanically supporting its respective seating rows 16 at two or more predetermined heights to adjust spectators' sightlines, such as by positioning of the seating rows 16 at either a shallower slope or reduced incline configuration (FIGS. 1A and 1C) or a steeper slope or increased incline configuration (FIGS. 1B and 1D), such as will be described below.

Each frame section 14*a-d* of telescopic framework 12 includes a pair of vertical support members or posts 20*a-d*, a pair of generally horizontal base frame members 22*a-d*, and a pair of upper horizontal frame members 24*a-d*. Each frame section 14*b-d* is sized and spaced to fit between and under the next-larger frame section 14*a-c*, and each of horizontal base frame members 22*b-d* is slidably or movably coupled to the corresponding next-larger base frame member 22*a-c*. In addition, telescopic framework 12 includes a stationary mounting or base portion 26 that includes a pair of horizontal mounting members 28 and a power/control base station 30.

Power/control base station 30 receives electrical power and/or compressed air for powering the extension, retraction, and raising and lowering functions of bleacher seating system 10, and may include a hydraulic pump and/or an air pump for pressurizing hydraulic fluid and/or air for use throughout the seating system. Power/control base station 30 delivers electrical power and/or hydraulic fluid and/or compressed air to powered drive system 34 and lift mechanisms 18 via electrical wiring and/or fluid/air conduits that pass through horizontal base frame members 22*a-d* and horizontal mounting members 28, and through vertical support posts 20*a-d*. For example, each bleacher seating system 10 may receive electrical service, rated at about 208 volts, 3-phase, and 30 amps, at power/control base station 30, while an air compressor unit for supplying compressed air may require 230-volt and 20-amp service. Clearly, other power sources or supplies or means may be utilized to power and control the extension/retraction of the seating system and raising/lowering of the lift mechanisms and locking/unlocking of the lift mechanism while remaining within the spirit and scope of the present invention.

Figure 6:
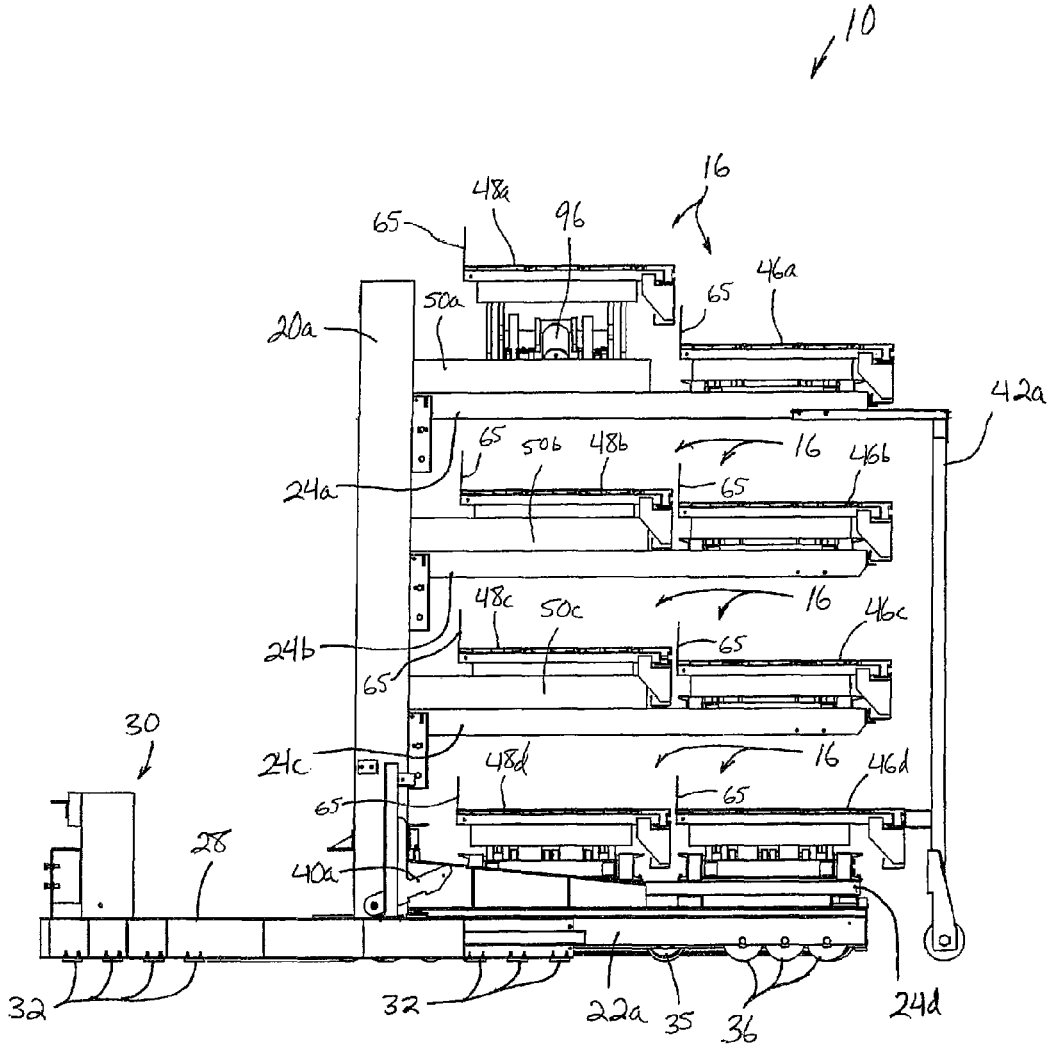
FIG. 6 is a side elevation of the bleacher seating system of FIGS. 1A-B, shown with the seating sections partially extended from the base portion.
Figure 6A:
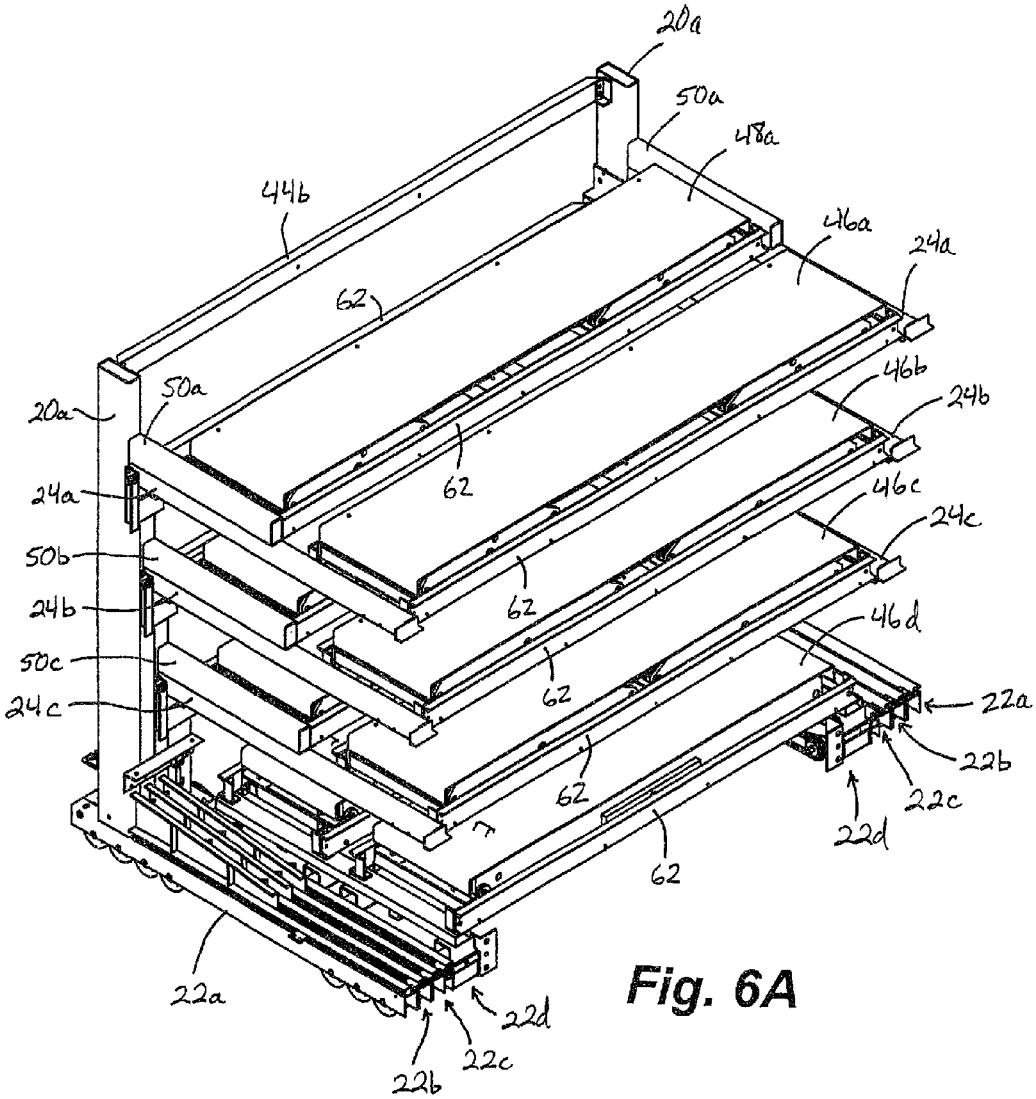
FIG. 6A is a perspective view of the bleacher seating system of FIGS. 1A-B, shown in a collapsed or fully-retracted configuration, and shown without the base portion.

Horizontal mounting members 28 of base portion 26 are rigidly or fixedly coupled to a support surface, such as a floor, with fasteners such as ground anchors 32 or the like (FIG. 6). Optionally, horizontal mounting members 28 may be fastened to a wall or substantially any other sufficiently rigid and supportive surface. Alternatively, the horizontal mounting members 28 may be temporarily mounted, or free-moving (such as on caster wheels or the like) for portability of the entire bleacher seating system.

Figure 5:
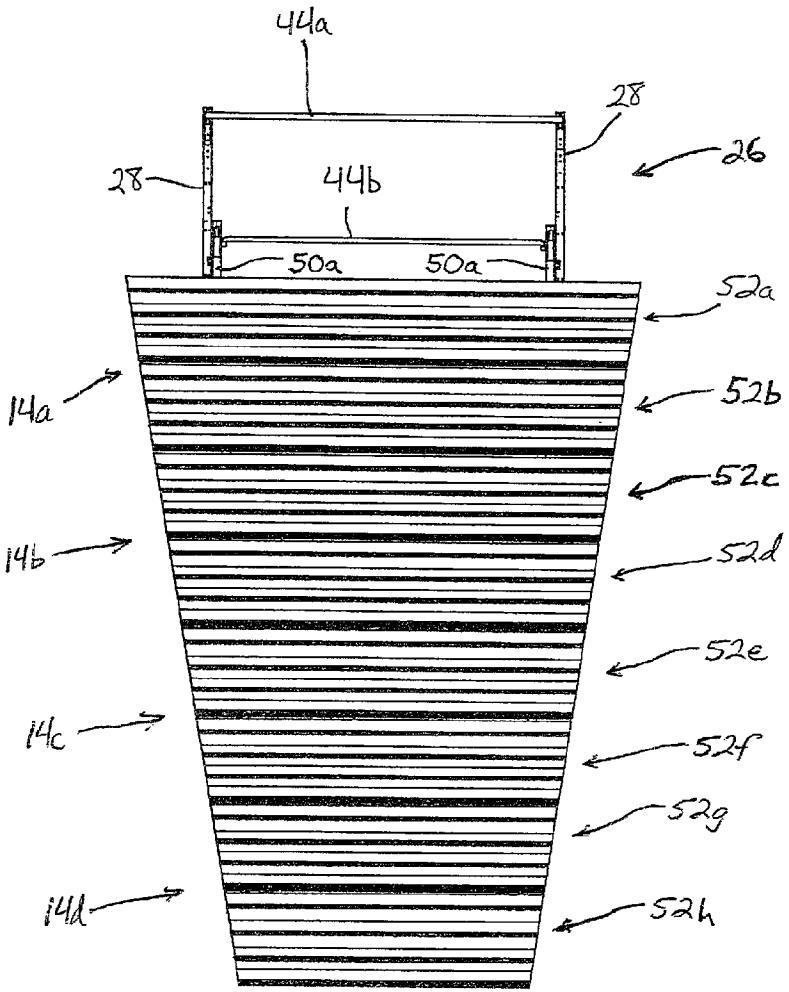
FIG. 5 is a top plan view of the bleacher seating system of FIGS. 1C-D.
Figure 5A:
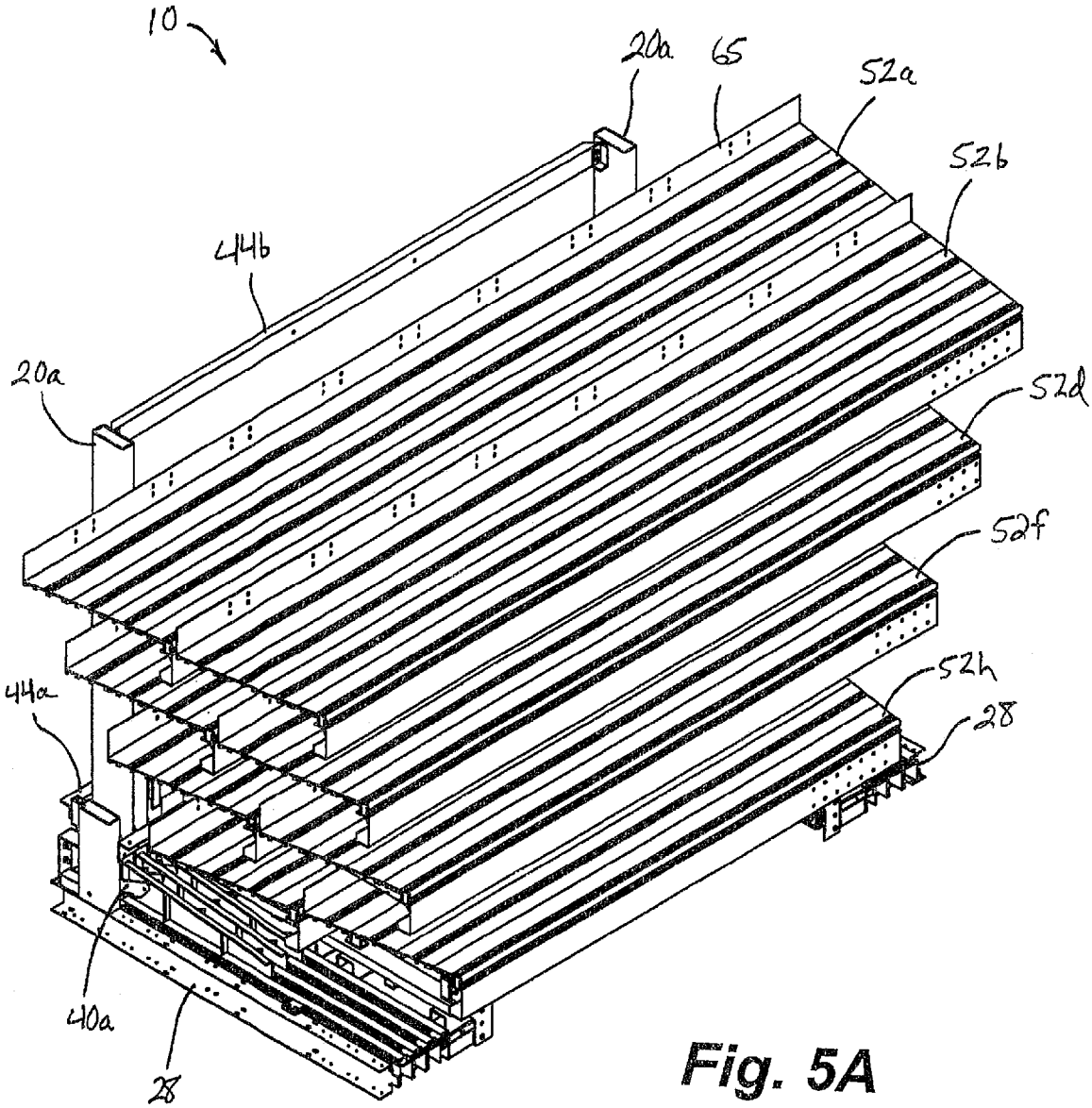
FIG. 5A is a perspective view of the bleacher seating system of FIGS. 1C-D, shown in a collapsed or fully-retracted configuration.
Figure 6B:
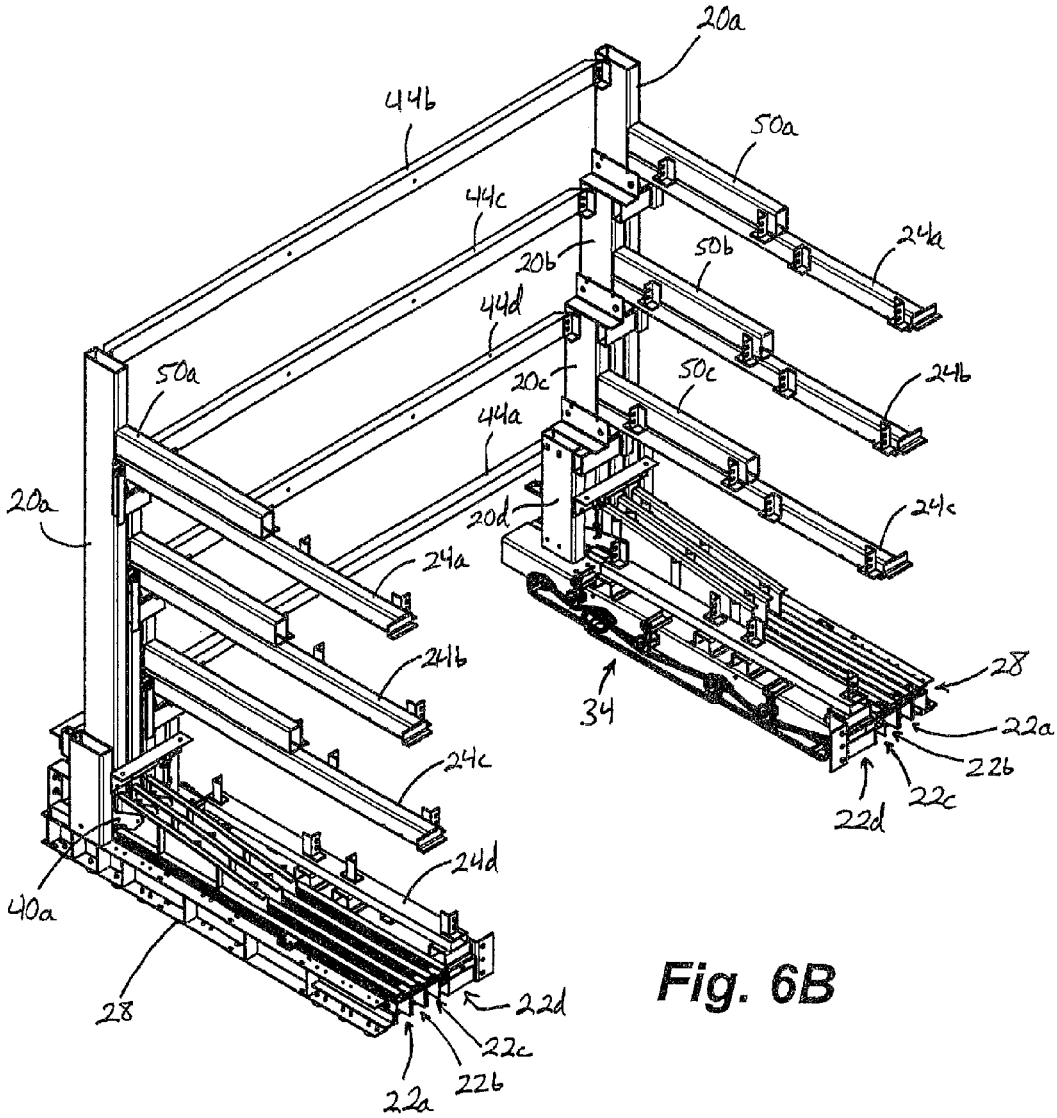
FIG. 6B is a perspective view of the telescopic framework of FIG. 2, shown in a collapsed or fully-retracted configuration.
Figure 7:
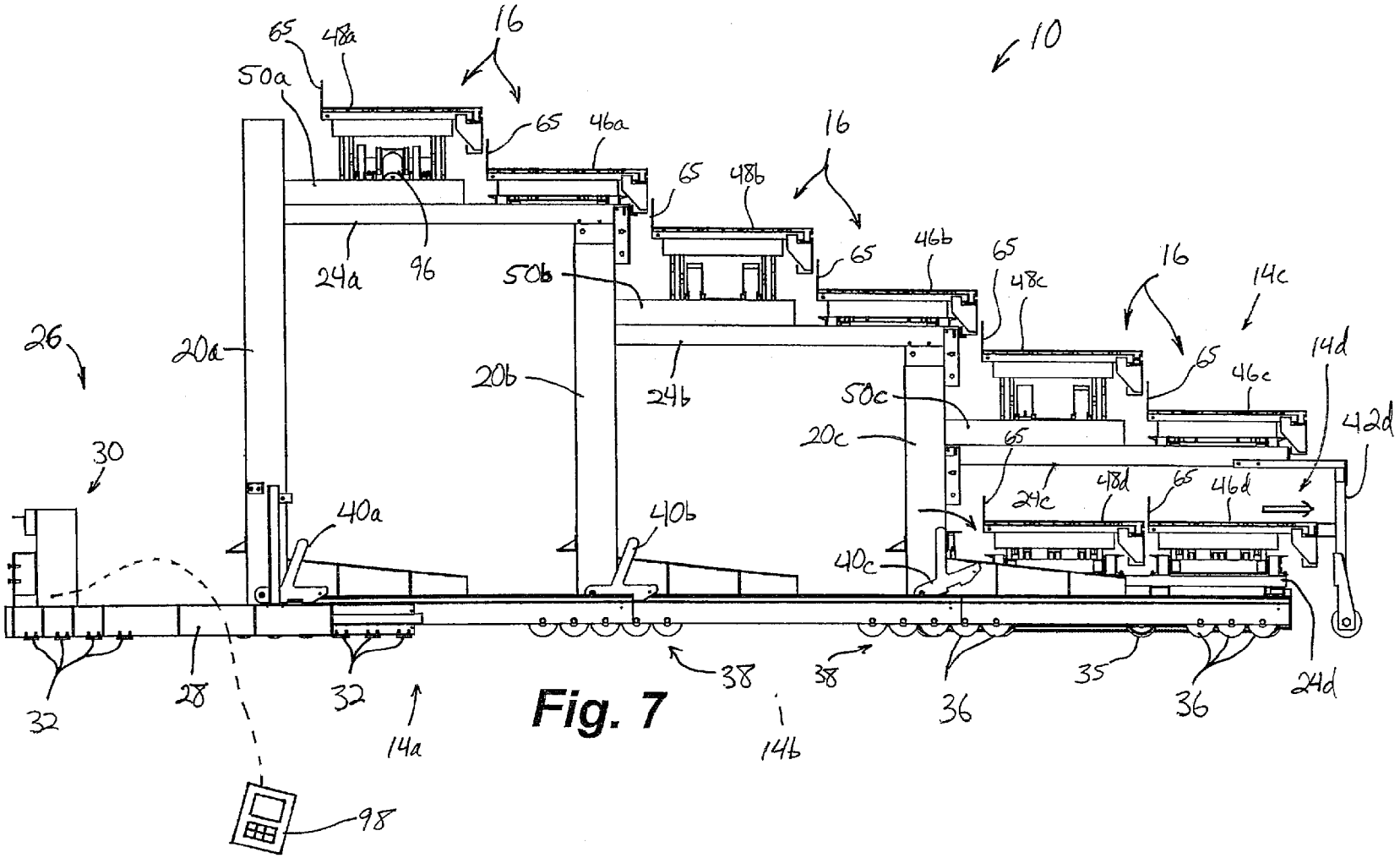
FIG. 7 is a side elevation of the bleacher system of FIG. 6, shown in a further extended configuration.

As best seen in FIGS. 2, 3, 5A and 6B, horizontal mounting members 28 are spaced apart to permit horizontal base frame members 22*a-d* to telescopically extend from, and retract into, the space defined between the horizontal mounting members 28. Each of horizontal base frame members 22*d* of frame section 14*d* includes a powered drive system 34, with each drive system 34 including an electric motor 35 and a plurality of chain-driven wheels 36 (FIGS. 6 and 7). Drive system 34 is operable to drive horizontal base frame members 22*d* outwardly to fully extend telescopic framework 12 (FIGS. 1A-D, 2, 4 and 5), and to drive horizontal base frame members 22*d* inwardly to collapse the telescopic framework (FIGS. 5A and 6-6B). Additional non-driven wheels 38 are provided along horizontal base frame members 22*a-c* to support and facilitate movement of the frame sections 14*a-c* along the support surface. Optionally, other drive means may be provided for extension and retraction of the seating or frame sections relative to one another and relative to the base section, such as drive means that impart relative movement between the adjacent frame sections, with the wheels being non-driven to provide rolling support of the sections as they are selectively extended and retracted.

Each frame section 14*a-d* includes a latch or lock 40*a-d* pivotally coupled to a lower end portion of the corresponding vertical support post 20*a-d*. Locks 40*a-d* automatically engage into a locking position (FIGS. 1A-D) to limit the maximum extent to which a given frame section may extend or project from the adjacent or next-largest frame section. During retracting of the telescopic framework 12, the locks 40*a-d* automatically pivot upwardly to an unlocked position (FIGS. 5A, 6, 6B and 7), such as via a portion of one of the outer sections contacting a lever arm of the lock to impart pivotal movement of the lock to its unlocked position as the outer section is retracted (or optionally via a powered actuator that causes the lock to pivot responsive to the retraction of the sections), to permit each frame section to collapse or telescope into the next-largest frame section. In FIG. 7, for example, frame sections 14*a* and 14*b* are shown fully extended with their corresponding pivoting locks 40*a*, 40*b* engaged, while pivoting lock 40*c* has not yet dropped into its locking position.

Figure 3:
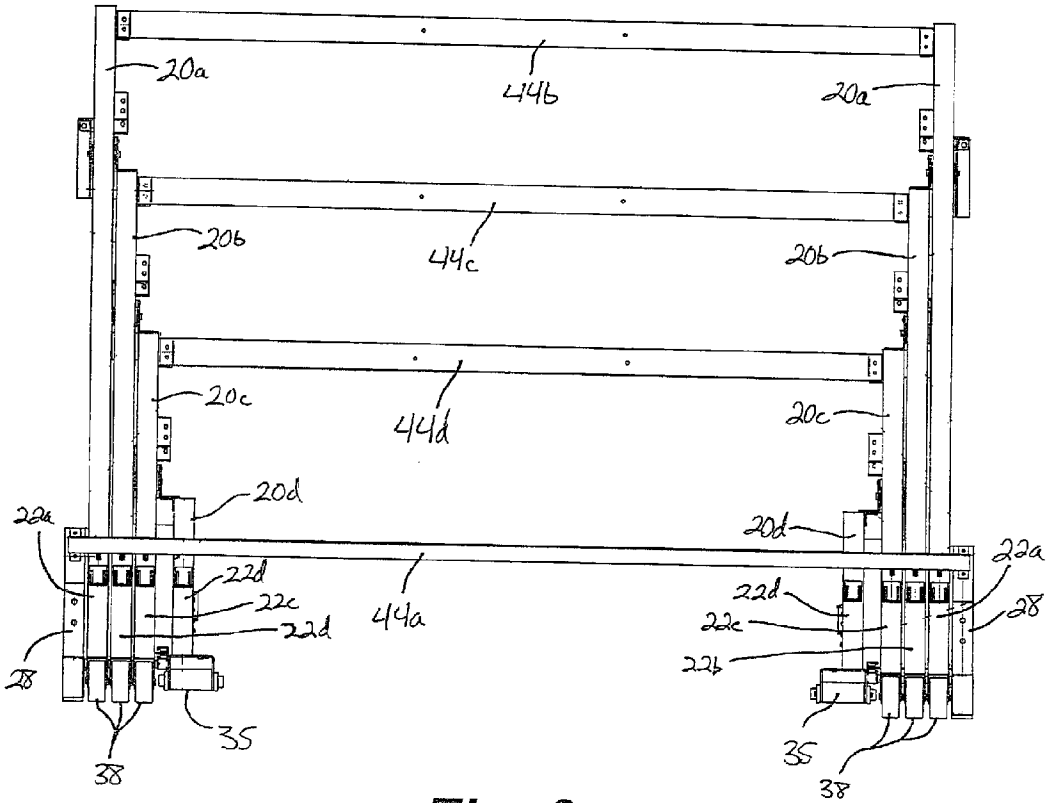
FIG. 3 is a rear end elevation of the telescopic framework of FIG. 2.
Figure 2:
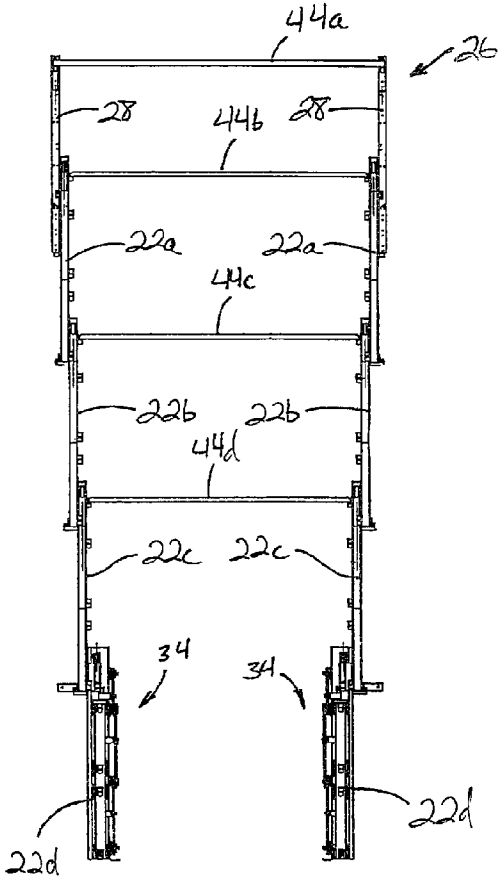
FIG. 2 is a top plan view of the telescopic framework of the bleacher system of FIGS. 1A-D.
Figure 4:
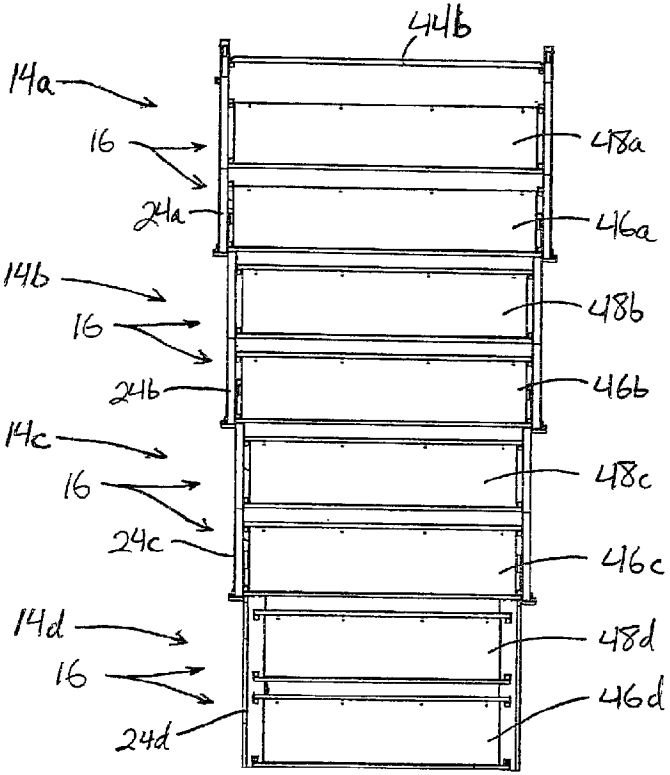
FIG. 4 is a top plan view of the telescopic framework of FIG. 2, showing deck portions mounted on the framework and without the base portion.

Corresponding left and right horizontal mounting members 28 of the base portion or section 26 are joined and stabilized by a lower cross member 44*a*, while the top or upper portions of vertical posts 20*a-c* of extendable seating or frame sections 14*a-c* are braced by respective upper cross members 44*b-d* (FIGS. 2, 3 and 6B). In the illustrated embodiment, horizontal upper frame members 24*a-c* are supported in cantilever fashion (at least when retracted) by their corresponding vertical support posts 20*a*, 20*b*, 20*c*, while vertical support post 20*d* includes a wheel-equipped support member 42*d* at its distal end portion (FIG. 7). When the seating system is at least partially extended, the vertical posts 20*b-d* of the outer sections 14*b-d* at least partially support the horizontal frame members 24*a-c* of the adjacent inner sections 14*a-c*. For example, upper frame member 24*a* may be supported by posts 20*a* and 20*b*, while upper frame member 24*b* is supported by posts 20*b* and 20*c*, and so on. Optionally, the vertical posts 20*b-d* may include a roller to provide support of the horizontal frame member as the seating sections are extended and retracted via the roller or the like slidably or rollingly engaging a lower surface or portion of the frame member of the next inner seating section. As can be seen in FIG. 6, when the system is fully retracted, a wheel-equipped support member 42*a* may be provided at the outer end of the upper frame member 24*a* of the inner section 14*a* to provide support at the outer end of the upper frame member 24*a* when the bleacher seating system is not in use.

Horizontal upper frame member 24*a-d* of each section 14*a-d* supports a corresponding pair of seating rows 16, with each seating row comprising a forward deck portion 46*a-d* and a rearward deck portion 48*a-d* (FIGS. 4, 6, 6A and 7). In the illustrated embodiment, rearward deck portions 48*a-c* are supported on partial upper horizontal frame members 50*a-c*, which are disposed at and above corresponding horizontal upper frame members 24*a-c*, and which encompass a rearward portion (such as about half) of the length of the horizontal upper frame members 24*a-c* (with the forward deck portions 46*a-c* disposed at the frame members 24*a-c* at a forward portion of the length of the frame members 24*a-c*) so that rearward deck portions 48*a-c* are raised relative to forward deck portions and are positioned at a height or level above their corresponding forward deck portions 46*a-c* when the deck portions are at their fully lowered or non-use positions by the lift mechanism, such as when the seating system is in its stowed or retracted configuration, as discussed below.

In the illustrated embodiment, horizontal base frame member 22*d* does not include a partial upper horizontal frame member so that the forward and rearward deck portions 46*d*, 48*d* are positioned at substantially the same height or level as one another in their lowered positions. Optionally, decking 52*a-h* may be added at the forward deck portions 46*a-d* and rearward deck portions 48*a-d* (with decking 52*a* corresponding to rearward deck portion 48*a*, decking 52*b* corresponding to forward deck portion 46*a*, decking 52*c* corresponding to rearward deck portion 48*b*, and so on, such as shown in FIGS. 1C-D, 5 and 5A) to provide a walking surface and/or a surface to which seating, such as folding chairs or benches, may be mounted. The chairs or other seating may be mounted at a rear portion of each section of decking 52*a-h*, such as to facilitate cleaning the decking. Suitable chairs that may be permanently or semi-permanently mounted to decking 52*a-h* include, for example, the MARQUEE™, MILLENIUM™, CITATION™, PATRIOT™, CENTURION™ and QUEST™ model chairs, available from Irwin Telescopic Seating Company, of Altamont, Ill. Additional accessories may be positioned or mounted on the decking and/or seating such as, for example, aisle lights, hand rails, intermediate aisle steps, armrests, cupholder arms, end rails, front rails and/or the like.

In the illustrated embodiment of FIGS. 1C-D, 5 and 5A, decking 52*a-h* is tapered for use in a curved or nonlinear perimeter region of a venue, such as in a curved end-zone region. Optionally, such as for bleacher seating systems used in straight or linear perimeter regions, the decking may have generally squared sides. Decking 52*a-h* may be made from any sufficiently strong, corrosion-resistant, and high-traction material such as, for example, plywood sheeting (with or without a carpet overlay), extruded aluminum sheeting, PANOLAM® brand thermofused panels (available from Panolam Industries International, of Shelton, Conn.), ALUMICLAD® brand aluminum composite panels (available from Alumiclad Pty. Ltd. of New South Wales, Australia), or the like.

Thus, the telescoping framework of the present invention provides an extendable and retractable stable support for spectator seating. The framework is collapsible or retractable into a compact configuration, such as into a space that has approximately the depth of only two rows of seating. The framework is coupled to a stationary mounting surface, and includes a power/control base station for routing electrical power and/or pressurized air and/or fluid throughout or along the framework for use in operating the bleacher seating system's various functions, as discussed below.

Referring now to FIGS. 8A-11G, the lift mechanism 18 that supports rearward deck portion 48*b* on frame section 14*c* is illustrated along a progression of positions, starting with a fully lowered or collapsed position (FIGS. 8A, 9A, 10A and 11A), progressing to a first predetermined height (FIGS. 8C, 9C, 10C and 11C), and finally progressing to a second predetermined height (FIGS. 8G, 9G, 10G and 11G). In the illustrated embodiment of FIGS. 8A-11G, lift mechanism 18 comprises a left pair of scissor mechanisms 54*a* and a right pair of scissor mechanisms 54*b* coupled between a support frame 58 and a deck frame 60. Support frames 58 are disposed at the frame members 24*a-d* and 50*a-c*, with the deck frames 60 supporting the forward deck portions 46*a-d* and rearward deck portions 48*a-d* and the seating elements (such as benches or seats or chairs or the like) disposed thereon. Actuation of the lift mechanisms 18 causes raising and lowering of the respective deck portions 46*a-d* and 48*a-d* relative to the frame members 24*a-d*, as discussed below.

Each pair of scissor mechanisms comprises a front scissor mechanism and a rear scissor mechanism spaced from one another to support the front and rear portions of the respective deck frame 60. The left scissor mechanisms 54*a* are substantially identical and aligned with one another and the right scissor mechanisms 54*b* are also substantially identical and aligned with one another, while the left scissor mechanism 54*a* and the right scissor mechanisms 54*b* are configured or arranged substantially as mirror images of one another and are configured to operate simultaneously to maintain the deck frame 60 in a substantially level orientation during raising and lowering operations. Each scissor mechanism 54*a*, 54*b* includes a lock mechanism 56 for selectively fixing the corresponding scissor mechanism at a predetermined height relative to the respective support frame 58, as will be described below.

Support frame 58 is supported by a corresponding one of horizontal upper frame members 24*a-d* and/or partial upper horizontal frame members 50*a-c*. Support frame 58 includes a pair of spaced apart beams or rails 62 that span between the corresponding pair of horizontal upper frame members 24*a-d* or partial upper horizontal frame members 50*a-c*. Rails 62 are stabilized and held in a fixed spaced apart arrangement by a plurality of crossbars 64, including at least two cross members 64*a*, 64*b* and a pair of center pivot supports 64*c*. Cross members 64*a*, 64*b* are positioned at each end of the support frame 58 and serve as first (outer) and second (inner) stop members, respectively, for the lock mechanism 56, discussed below. Deck frame 60 is constructed similarly to support frame 58, including a pair of spaced apart rails and a plurality of cross members for rigidity, with one of deck portions 46*a-d* or 48*a-d* coupled to each of the deck frames 60. Optionally, a vertical kick plate 65 (FIGS. 1C-D, 5A, 6 and 7) may be included and may extend upwardly along the back of each deck frame 60, so as to overlap a forward portion of the deck frame positioned rearward of the kick plate, in order to provide a safety feature by reducing the risk that spectators may lose their footing, or may lose loose articles while the spectators are supported on a given seating row.

Figure 8A:
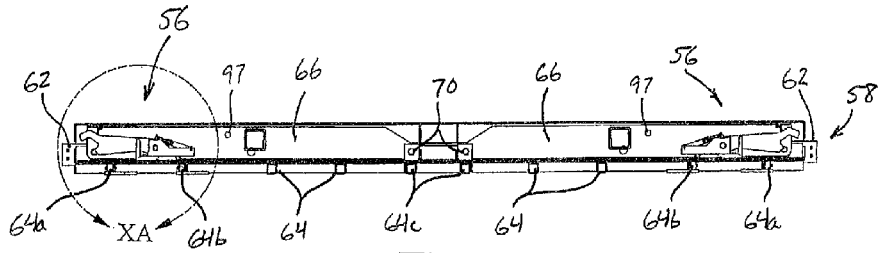
FIGS. 8A-G are front partial-sectional elevations of a lift mechanism in accordance with the present invention, shown progressing through various stages of adjusting a deck portion between a fully lowered configuration and a fully raised configuration.
Figure 8B:
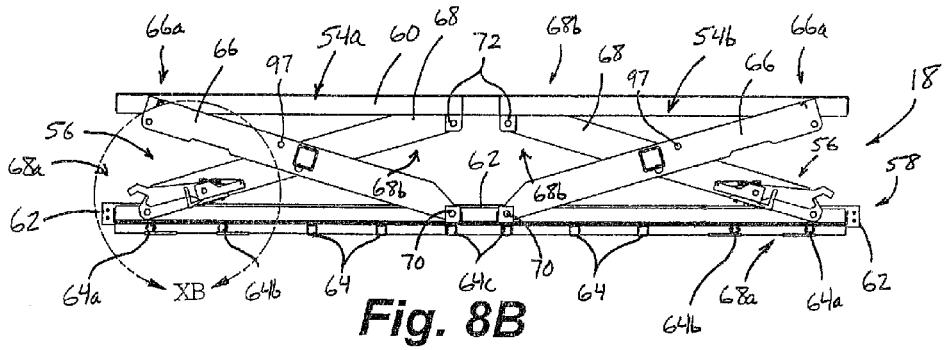
Figure 8C:
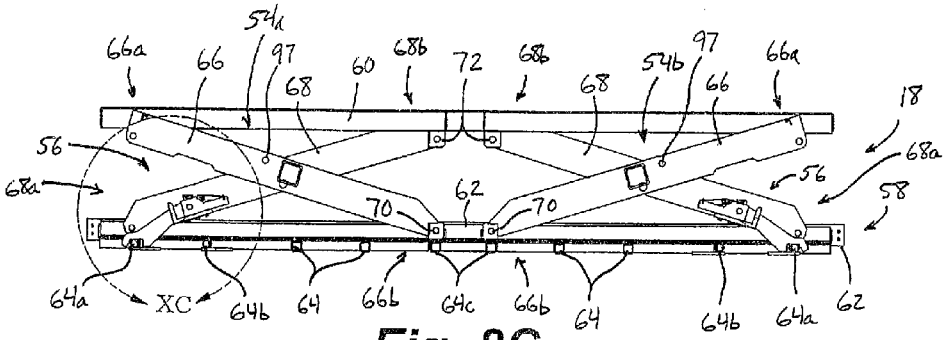
Figure 8D:
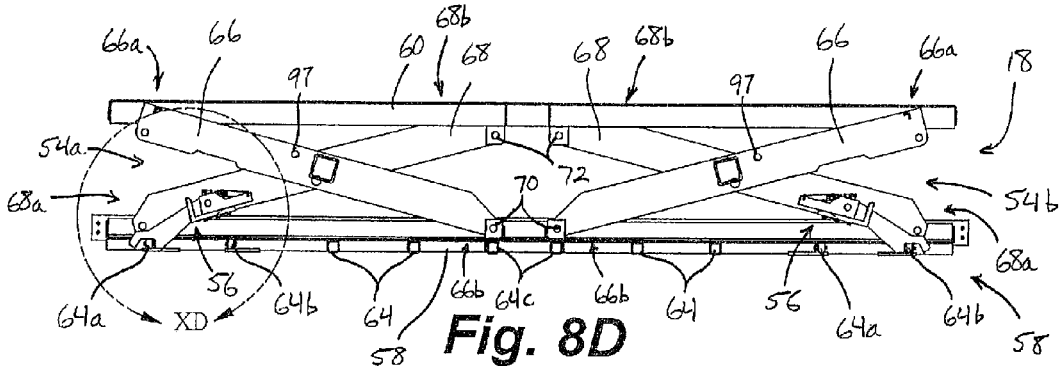
Figure 8E:
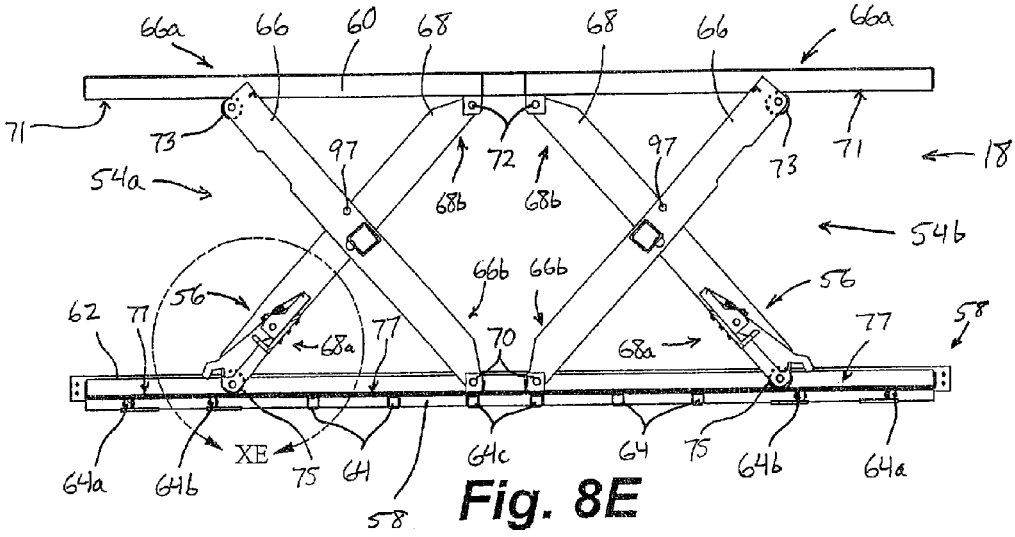
Figure 8F:
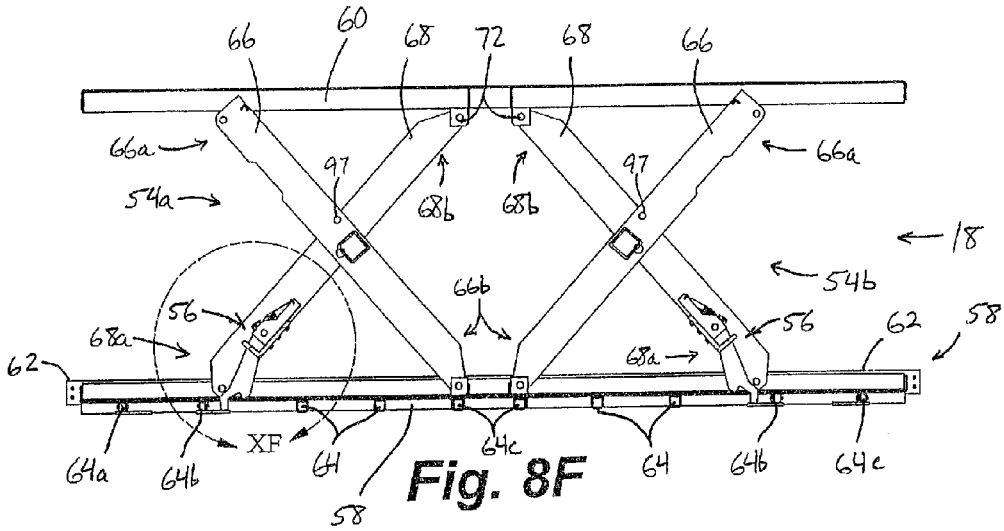
Figure 8G:
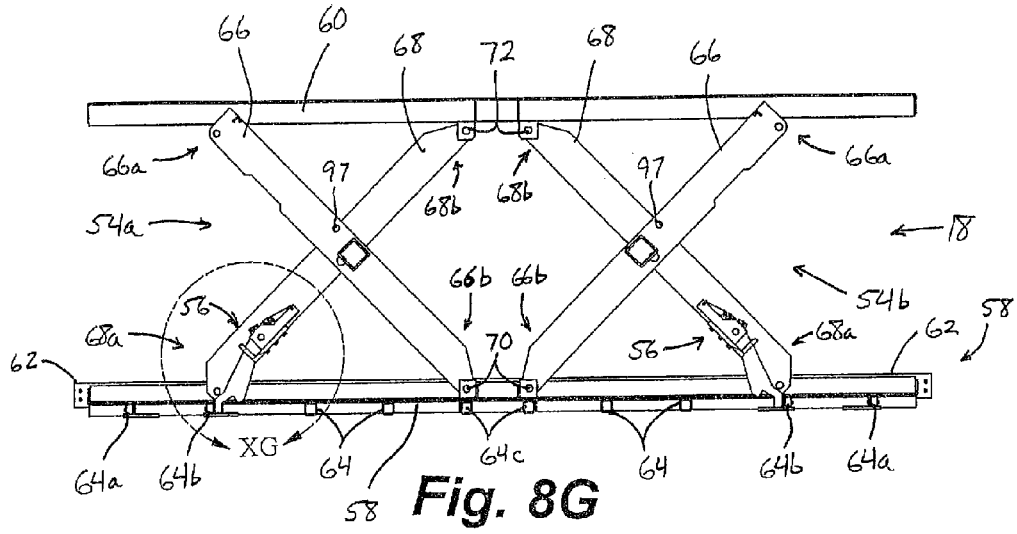
Figures 9A, 9B, 9C:
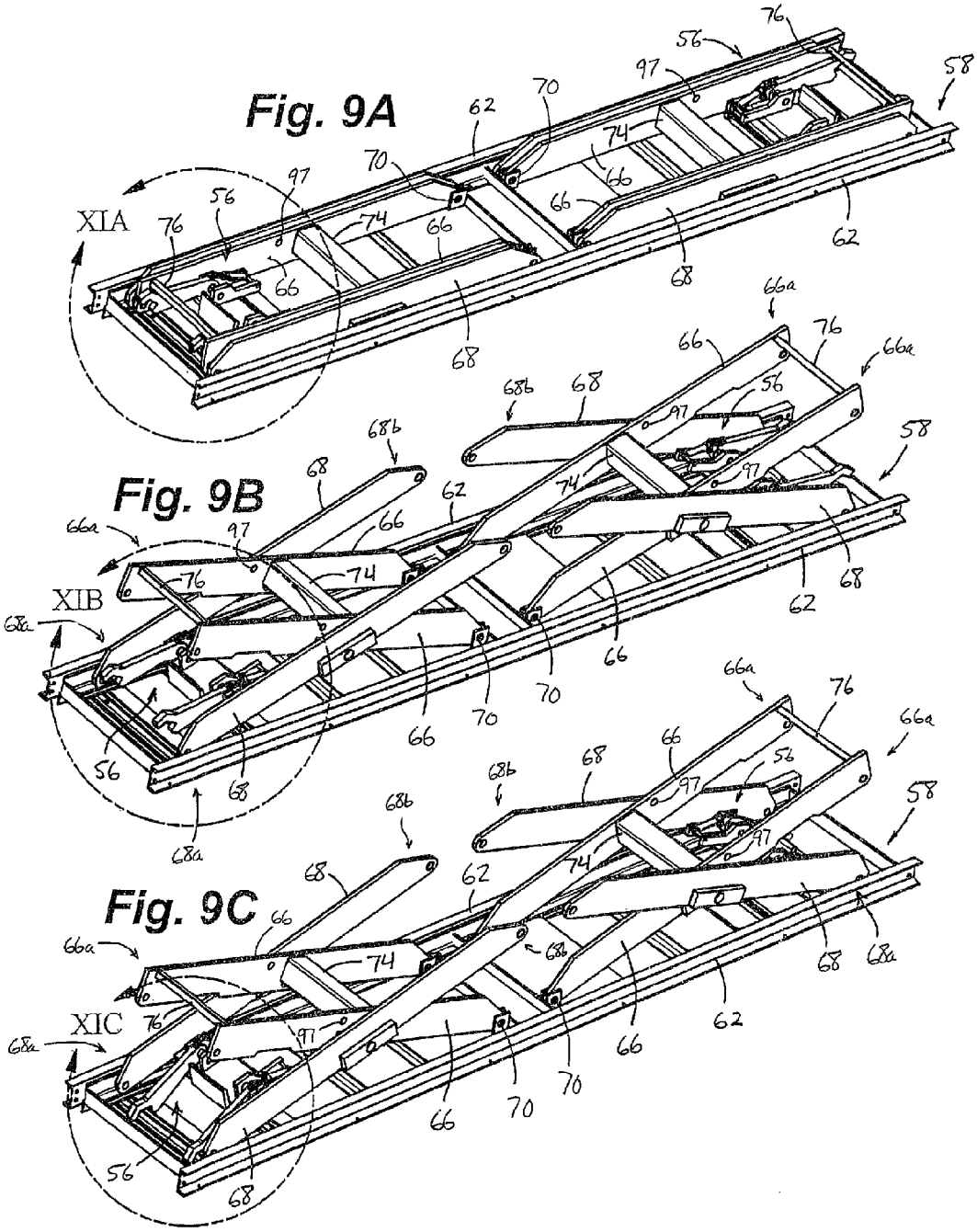
FIGS. 9A-G are perspective views of the lift mechanisms of FIGS. 8A-G, with deck frames and deck portions removed for visibility.
Figure 9D:
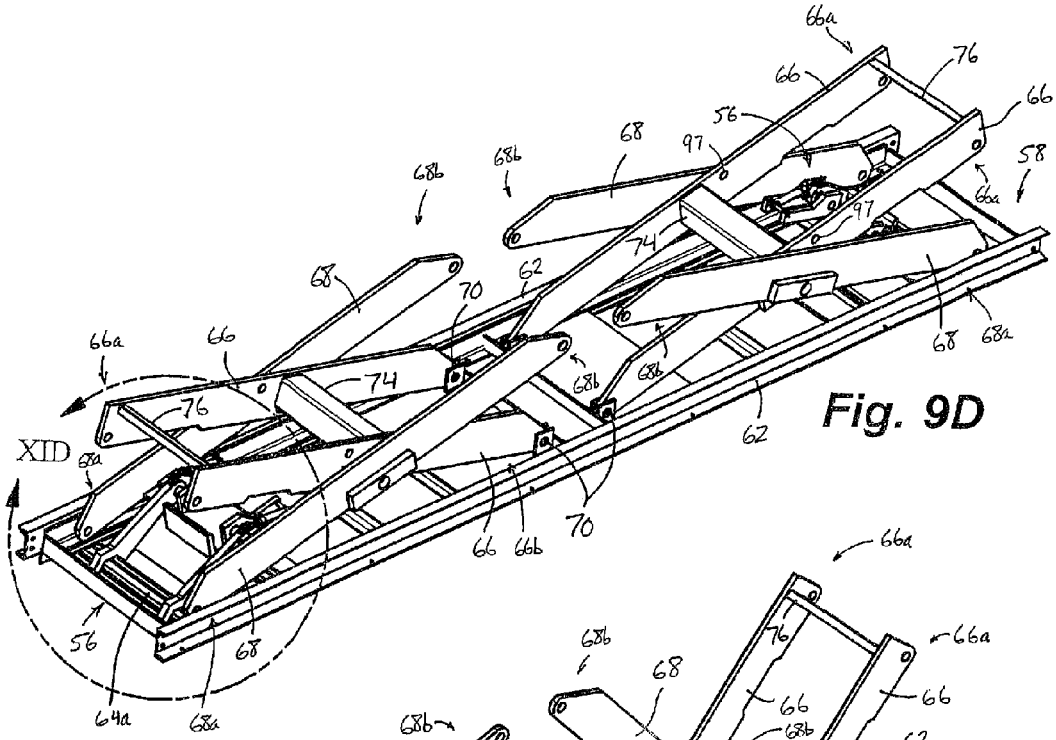
Figure 9E:
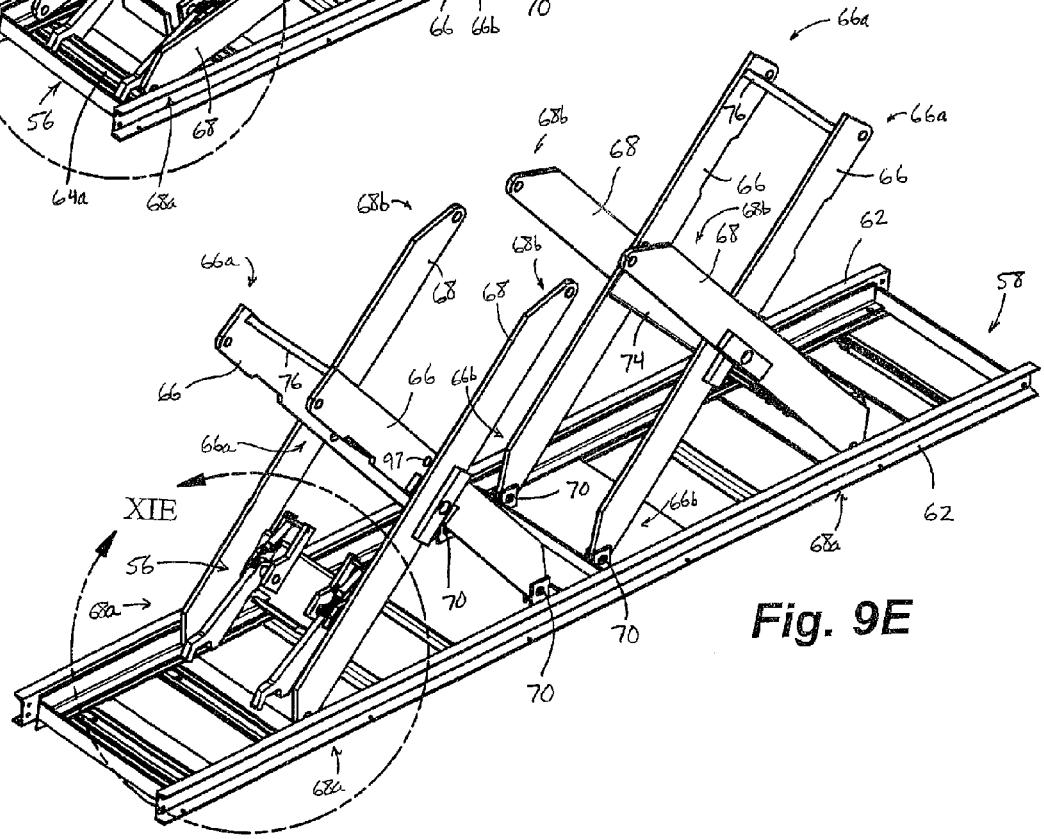
Figure 9F:
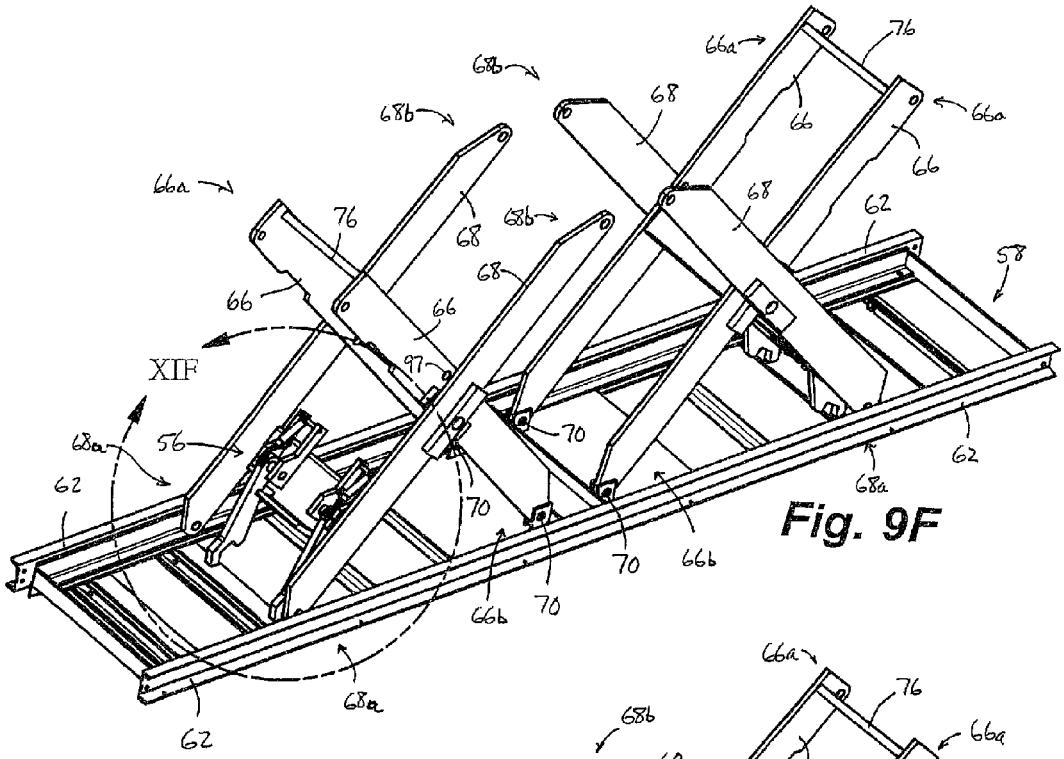
Figure 9G:
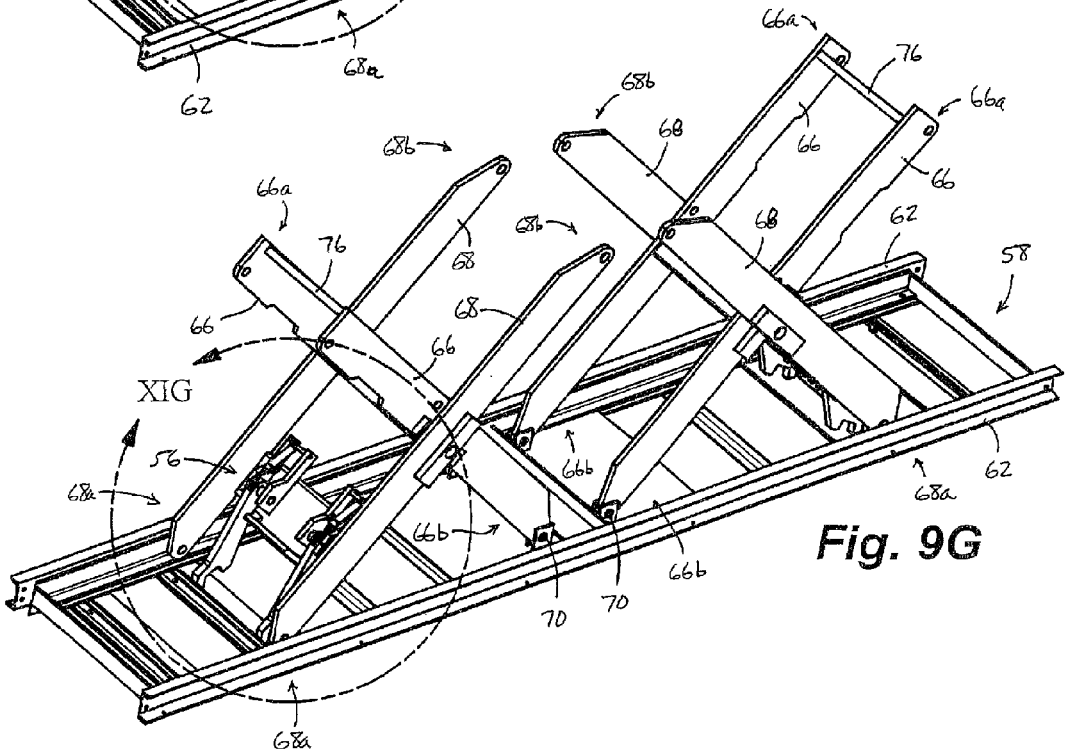
Figure 10A:
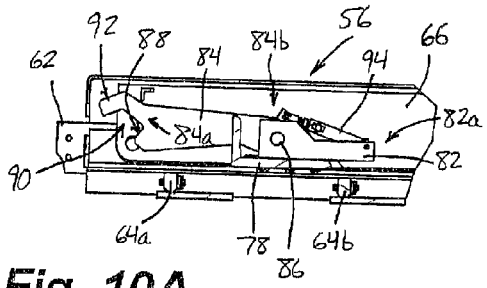
FIGS. 10A-G are enlarged front elevations of the areas designated XA-XG of FIGS. 8A-G.
Figure 11A:
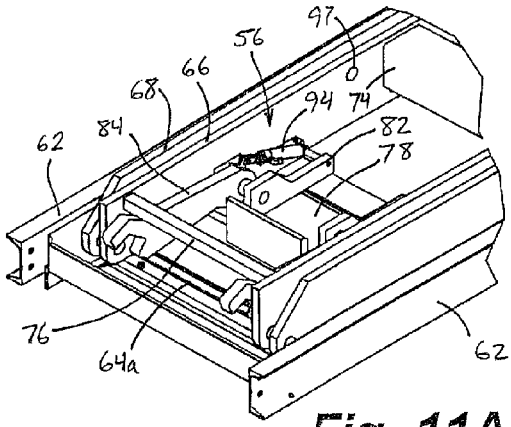
FIGS. 11A-G are enlarged perspective views of the regions designated XIA-XIG of FIGS. 9A-G.
Figure 10B:
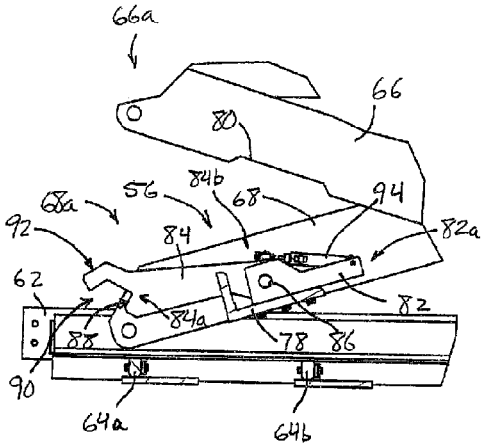
Figure 11B:
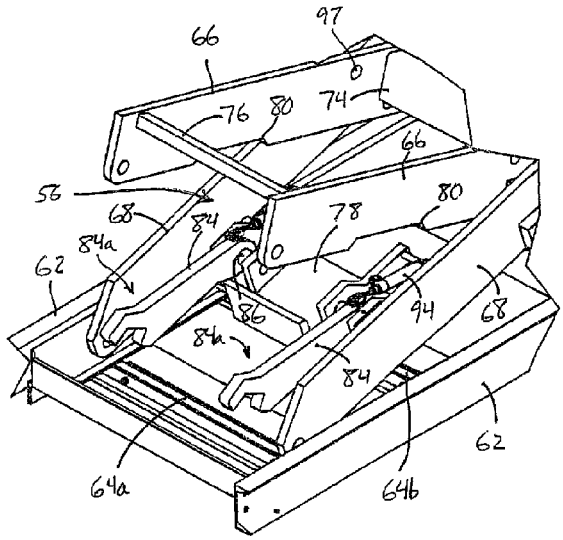
Figure 10C:
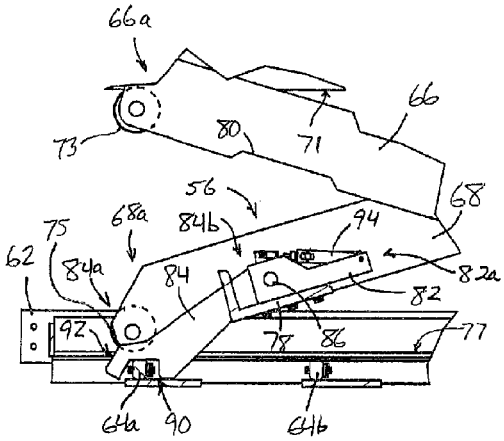
Figure 11C:
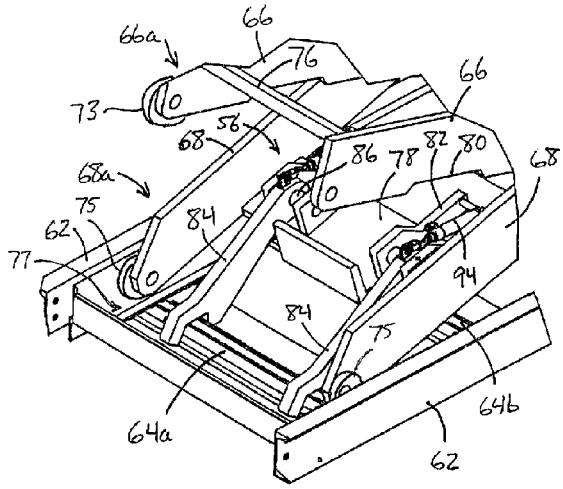
Figure 11D:
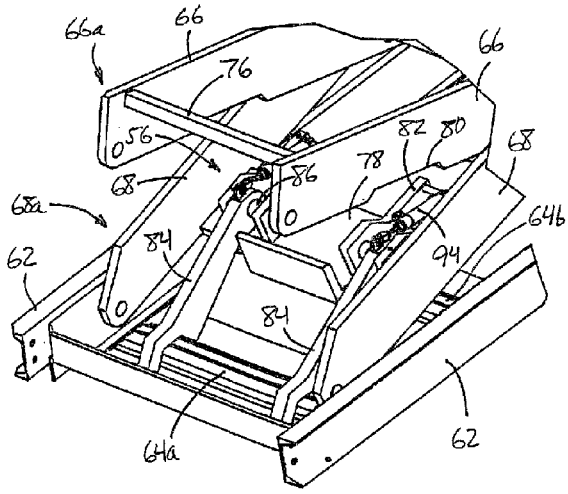
Figure 11E:
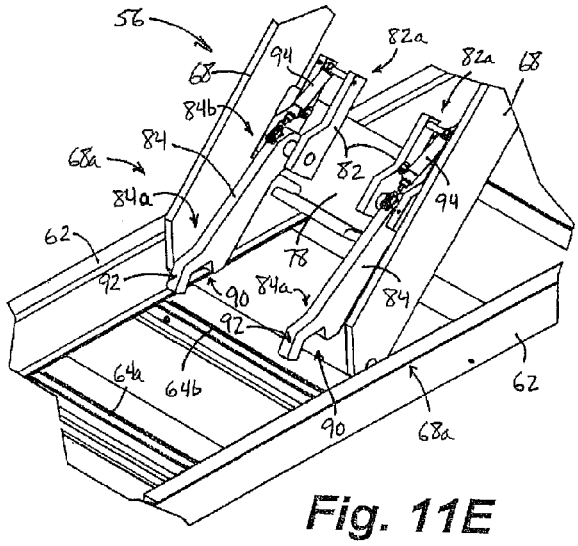
Figure 11F:
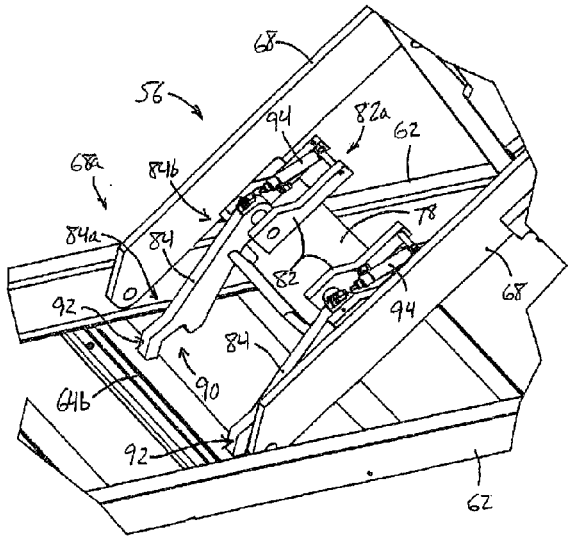

Each scissor mechanism 54*a*, 54*b* includes a first pivotable cross member 66 and a second pivotable cross member 68. Each pivotable cross member 66, 68 has an outboard end portion 66*a*, 68*a* and an inboard end portion 66*b*, 68*b*. Inboard end portions 66*b* of first pivotable cross members 66 are pivotally coupled to respective support frame pivots 70 at center pivot supports 64*c* (FIGS. 8A-9G). Similarly, inboard end portions 68*b* of second pivotable cross members 68 are pivotally coupled to deck frame 60 at deck frame pivots 72. Outboard end portions 66*a* of first pivotable cross members 66 are pivotably and slidably or movably coupled to deck frame 60 at or along an inner receiving channel or track or rail 71, which is adapted to receive a wheel 73 or pin or other projection at the outboard end portion 66*a* of first pivotable cross members 66 (FIGS. 8E, 10C and 11C). Similarly, outboard end portions 68*a* of second pivotable cross members 68 are coupled to rails 62 of support frame 58 in a pivoting and sliding or moving manner, such as via wheels 75 or pins or other projections of the cross members 68 engaging receiving channels or tracks 77 in or along an inner surface of rails 62. Thus, as deck frame 60 is raised relative to support frame 58 by lift mechanisms 18 (such as via extension and retraction of an actuator 96, discussed below), first and second pivotable cross members 66, 68 of scissor mechanism 54*a*, 54*b* pivot about their respective support frame pivot 70 or deck frame pivot 72, without translating, while outboard end portions 66*a*, 68*a* of first and second pivotable cross members 66, 68 translate along deck frame 60 and support frame 58, respectively, while pivoting to permit left and right scissor mechanisms 54*a*, 54*b* to raise the deck frame, such as can be seen with reference to FIGS. 8D and 8E.

In the illustrated embodiment, each of the first pivotable cross members 66 are positioned inboard of, and pivotally coupled to, their corresponding second pivotable cross members 68 at approximately mid-span, between outboard end portions 66*a*, 68*a* and inboard end portions 66*b*, 68*b*. The first pivotable cross members 66 of a given left or right scissor mechanism 54*a*, 54*b* are coupled to one another via a stabilizing crossbar 74 located approximately mid-span between outboard end portion 66*a* and inboard end portion 66*b* (FIGS. 9A-D). In addition, a secondary stabilizing crossbar 76 may be provided between each outboard end portion 66*a* of corresponding first pivotable cross members 66. Each of the stabilizing crossbars 74, 76 serves to stabilize the respective left or right scissor mechanism 54*a*, 54*b*, and also ensures that pairs of scissor mechanisms remain synchronized throughout the raising and lowering process. A bracket 78 (FIGS. 10A-11G) extends inwardly from the outboard end portion 68*a* of each second pivotable cross member 68 and supports an end of an actuator of the lift mechanism 54 and supports the lock mechanism 56, as discussed below. First pivotable cross members 66 include notches 80 at their lower surfaces to accommodate brackets 78 so that scissor mechanisms 54*a*, 54*b* may be fully lowered with first pivotable cross members 66 and second pivotable cross members 68 being substantially parallel and adjacent to one another (such as shown in FIGS. 8A, 9A, 10A and 11A).

Left and right scissor mechanisms 54*a*, 54*b* are raisable and lowerable via actuators 96, such as hydraulic actuators (shown below rear deck portion 48*a* in FIGS. 6 and 7) coupled between each bracket 78 and corresponding stabilizing crossbar 74 (such as at a pivot pin or mounting pin 97). Hydraulic actuators 96 may be double-acting extendable and retractable piston-cylinders for raising and lowering the scissor mechanisms responsive to pressurized fluid provided at either end of the cylinder, or they may be single-acting piston-cylinders whereby pressurized hydraulic fluid is pumped into the cylinder to extend the actuator and raise the scissor mechanisms, and relief valves are opened to reduce the pressure in the cylinder to allow retraction of the actuator and lowering of the scissor mechanisms under the load of the deck and seating supported by the lift mechanism. Although hydraulic actuators are shown and described for the purpose of actuating the scissor mechanisms, it will be appreciated that substantially any mechanical actuator may be used to raise and lower the scissor mechanisms, such as linear actuators or electrical or pneumatic actuators or the like.

Actuators 96 are actuatable in response to signals received from power/control base station 30. Accordingly, left and right scissor mechanisms 54*a*, 54*b* are cooperatively raisable and lowerable to raise and lower the respective deck portion to which the scissor mechanisms are coupled. Scissor mechanisms 54*a*, 54*b* are operable between a substantially flat or fully lowered position (FIGS. 8A, 9A, 10A and 11A) and various raised positions (FIGS. 8B-G, 9B-G, 10B-G and 11B-G). Although scissor mechanisms 54*a*, 54*b* may be positioned at substantially any height between the fully lowered position and a fully raised position (such as up to or beyond the height shown in FIGS. 8F-G, 9F-G, 10E-G and 11F-G), they are selectively adjusted or extended/retracted to one of a plurality of preselected or predetermined heights depending on the particular application of the seating system, as discussed below. Suitable scissor mechanisms such as those shown and described herein include, for example, the Series 35 hydraulic scissors lift table, available from Autoquip Corp. of Guthrie, Okla.

Although the lift mechanism discussed above is shown and described as having left and right pairs of scissor mechanisms, it will be appreciated that substantially any number of scissor mechanisms may be used. For example, a relatively large single scissor mechanism (or single pair of fore/aft spaced scissor mechanisms, such as shown in FIG. 1C) may be used to achieve particularly large height changes (such as for raising and lowering the forward and rearward deck portions 46*d*, 48*d* on frame section 14*d* in FIGS. 1A-D), or three or more sets or pairs of scissor mechanisms may be used where relatively small height changes are needed. In addition, the scissor mechanisms' inboard end portions may overlap to some degree, such as to permit the use of left and right pairs of scissor mechanisms that are larger than would otherwise be possible if the scissor mechanisms did not overlap, as in the non-overlapping scissor mechanisms of FIGS. 8A-11G. It is also envisioned that scissor mechanisms may be stacked atop one another to achieve greater height changes, without departing from the spirit and scope of the present invention. It is further envisioned that any other type of suitable raising/lowering mechanism or device (such as vertically extendable/retractable actuators or hydraulic cylinders or linear actuators or the like) may be implemented to selectively raise and lower the deck portions of the seating system, while providing selective locking of the deck portions at selected or predetermined heights, while remaining within the spirit and scope of the present invention.

Additional stabilization and load-bearing capacity may be provided by lock mechanisms 56 when the scissor mechanisms are at certain predetermined heights. In the illustrated embodiment, lock mechanisms 56 permit scissor mechanisms 54*a*, 54*b* to be positioned and set at two different predetermined heights without relying on the hydraulic system for supporting loads on the deck portions 46*a-d*, 48*a-d*. As best seen in FIGS. 10A-G and 11A-G, each locking mechanism 56 is coupled to one of the brackets 78, which extend between the outboard end portions 68*a* of each pair of second pivotable cross members 68.

Lock mechanism brackets 82 are fastened to bracket 78 and spaced sufficiently inwardly from second pivotable cross members 68 to permit first pivotable cross members 66 to occupy the spaces between lock mechanisms 56 and second pivotable cross members 68 when in a nearly or fully lowered position. A locking member 84 is pivotally coupled to lock mechanism bracket 82 at its proximal end portion 84*b* via a pivot pin 86 or the like. Locking member 84 extends outwardly along outboard end portion 68*a* of second pivotable cross member 68 and terminates at a distal end portion 84*a* having a first bumper stop surface 88 that partially defines a recess 90 (FIGS. 10A-11G). Recess 90 is further defined by a second bumper stop surface 92 spaced distally outwardly from first bumper stop surface 88.

An actuator 94 (such as, for example, a double-acting pneumatic actuator) is coupled between a proximal end portion 84*b* of lock member 84 and a distal end portion 82*a* of lock mechanism bracket 82. Actuator 94 is operable to pivot lock member 84 between a locked or engaging position and unlocked or disengaging position, as will be described below. In the illustrated embodiment, depending on the extent to which left and right scissor mechanisms 54*a*, 54*b* are raised, lock member 84 may be positioned in an unlocked position (FIGS. 8A, 8B, 8E, 9A, 9B, 9E, 10A, 10B, 10E, 11A, 11B and 11E) and a locked position (FIGS. 8C, 8D, 8F, 8G, 9C, 9D, 9F, 9G, 10C, 10D, 10F, 10G, 11C, 11D, 11F and 11G) by actuator 94. Although actuators 94 are shown and described as pneumatic actuators for the purpose of actuating or moving or adjusting the locking members, it will be appreciated that substantially any suitable actuator may be used to move and position the lock members between their locked and unlocked positions, such as electrical or hydraulic or electromechanical actuators or the like.

In the illustrated embodiment, locking member 84 is configured to receive first or outer stop member 64*a* in recess 90 when the lift mechanism is set and locked at a first level or height or degree of extension (FIGS. 10C-D and 11C-D), while the portion of distal end portion 84*a* of lock member 84, which includes second bumper stop surface 92, is configured to be lowered into abutment with second stop member 64*b* when the lift mechanism is set and locked at a second level or height or degree of extension (FIGS. 10E-G and 11F-G). First and second bumper stop surfaces 88, 92 are angled or non-parallel to one another and are formed at respective angles so that each surface flatly or perpendicularly abuts first and second stop members 64*a*, 64*b*, respectively, when the second cross members 68 to which lock mechanisms 56 are attached are pivoted or angled to their first and second height configurations, such as can be seen with reference to FIGS. 8D and 8G.

Optionally, it will be appreciated that each locking member may comprise a pair of locking members that are independently actuated by separate actuators, where each locking member includes just one bumper stop surface for engaging a respective one of the corresponding first or second stop member 64*a*, 64*b*. It will further be appreciated that other lift mechanisms, substantially similar to lift mechanism 18, are envisioned that provide only one predetermined height above the stowed or fully-lowered configuration, or that provide for three or more predetermined heights. The number of predetermined heights is determined according to the number and location of stop members along the support frame. For example, stop members located inboard of second stop members 64*b* would correspond to a third predetermined height of that seating row, which is higher than the second predetermined height of that seating row.

Figure 1B:
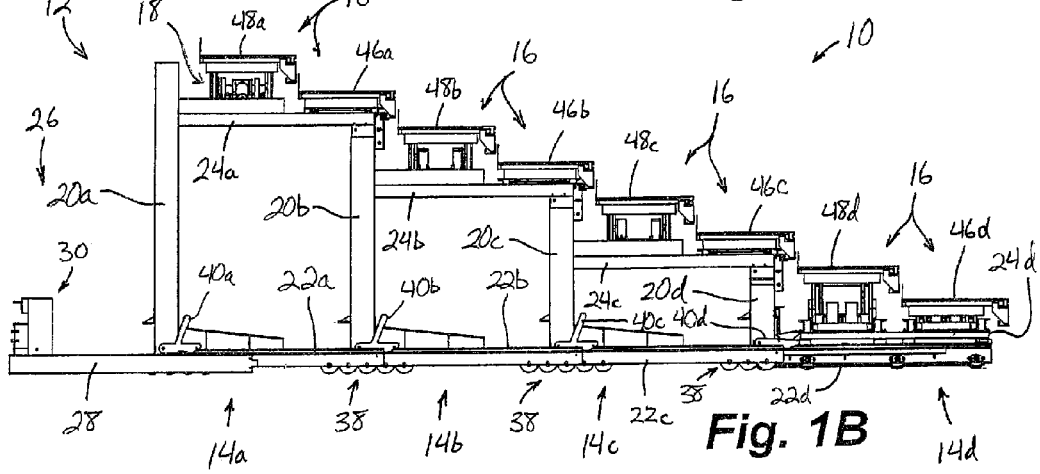
FIG. 1B is another side elevation of the bleacher seating system of FIG. 1A, shown with the seating arrangement in a steeper-slope configuration.
Figure 1C:
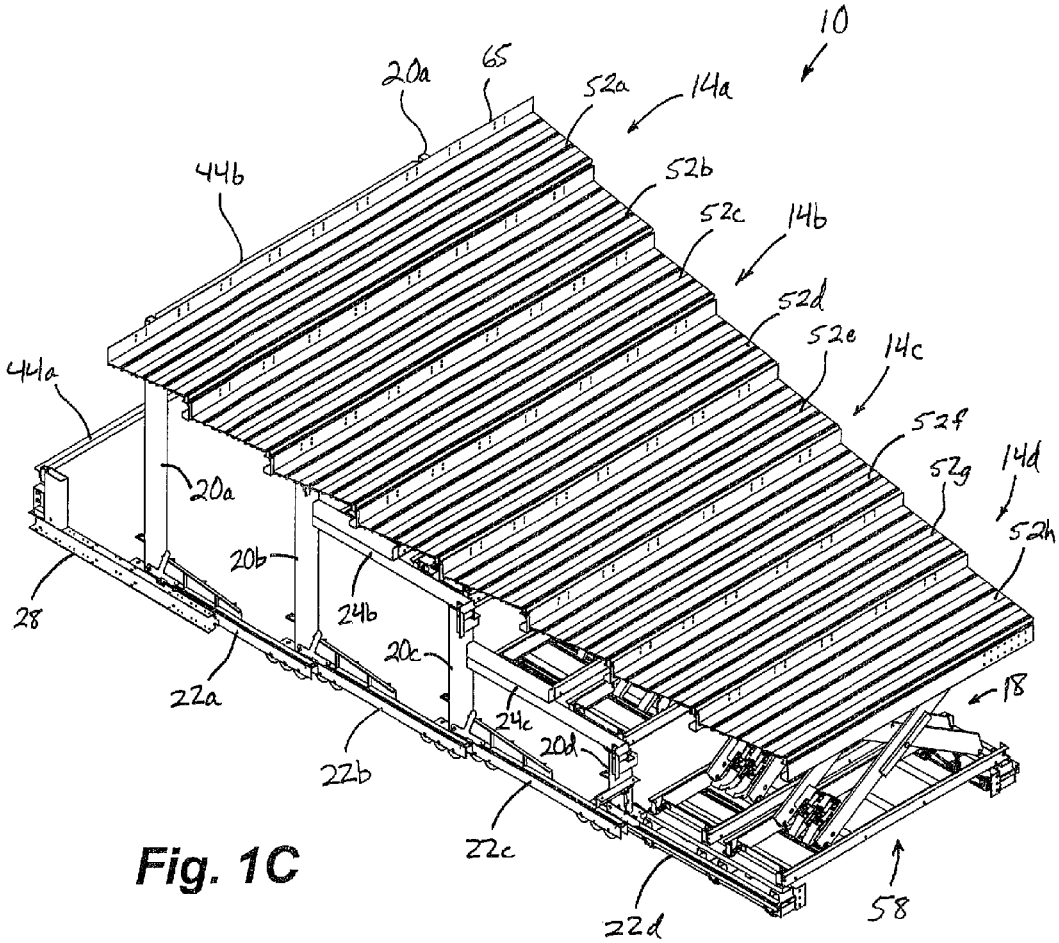
FIG. 1C is a perspective view of the bleacher seating system of FIG. 1A, including tapered decking.
Figure 1D:
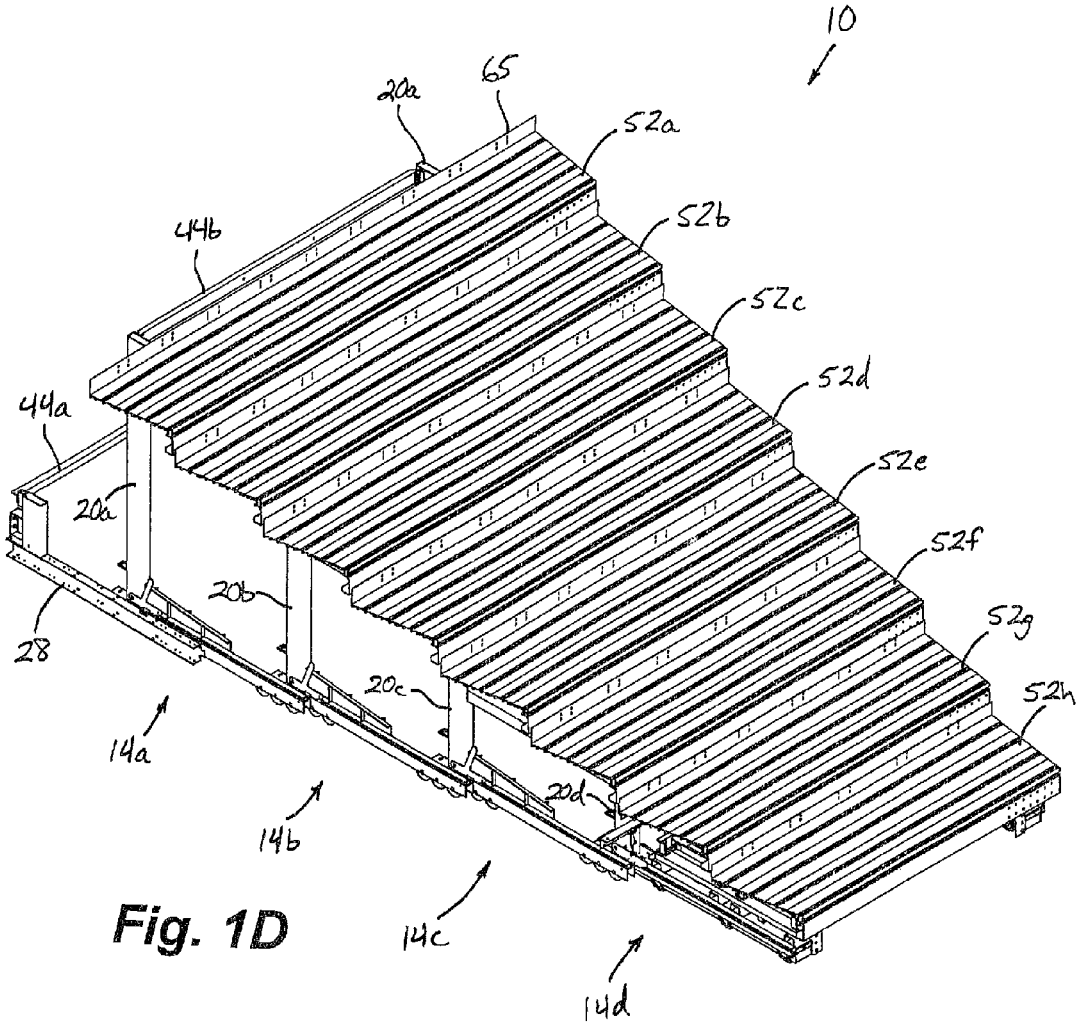
FIG. 1D is a perspective view of the bleacher seating system of FIG. 1B, including tapered decking.

As can be seen with reference to FIGS. 1A and 1B, the height or degree of lift provided by the lift mechanisms at their locked state or states may vary depending on the row or section at which the lift mechanism is located. For example, the lift mechanism corresponding to deck portion 48*a* at the rear of the deck or section 14*a* may lock at a lower first position than the first positions of the lift mechanisms corresponding to deck portions 48*b-d* to provide a desired slope of the deck portions (FIG. 1B), especially since the deck portions are already supported at different elevations depending upon which of upper horizontal frame members 24*a-d* or partial upper horizontal frame members 50*a-c* supports each lift mechanism. As discussed above, the height of each lift mechanism at its first position is determined by the length of the pivotable cross members of the scissor mechanisms, and by the placement of the outer stop members 64*a* along support frames 58, the outer stop members 64*a* being engaged by first bumper stop surfaces 88 of locking members 84. Thus, the precise height of each lift mechanism at its first position may be set by the placement of outer stop members 64*a* and/or by the selection of a desired length of pivotable cross members. Similarly, the height of each lift mechanism at its second position is determined by the length of the pivotable cross members of the scissor mechanisms, and by the placement of the inner stop members 64*b* along support frames 58, the inner stop members 64*b* being engaged by second bumper stop surfaces 90 of locking members 84.

In the illustrated embodiment of FIGS. 1A and 1B, the pivotable cross members corresponding to deck portions 46*d*, 48*d* of frame portion 14*d* may be longer than the cross members corresponding to deck portions 46*c*, 48*c*, which may be longer than the cross members corresponding to deck portions 46*b*, 48*b*, etc. Additionally, the outer and/or inner stop members 64*a*, 64*b* corresponding to deck portions 46*d*, 48*d* may be placed further inboard along their respective support frames 58 than the outer and/or inner stop members 64*a*, 64*b* corresponding to deck portions 46*c*, 48*c*, etc. so that the lift mechanisms for each row or section are positionable and lockable at different heights. By further example, the lift mechanisms supporting deck portions 46*d*, 48*d* of frame portion 14*d* (which does not include partial upper horizontal frame members) may be identically-sized, while the inner and outer stop members corresponding to front deck portion 46*d* (assuming, for the moment, that the lift mechanism for front deck portion 46*d* includes outer stop members) are positioned outboard relative to the corresponding inner and outer stop members for rear deck portion 48*d* so that when the lift mechanisms are in their first position (FIG. 1B) and second position (FIG. 1A), rear deck portion 48*d* is positioned at a higher elevation than forward deck portion 46*d*. The ability to set each lift mechanism at different heights according to the selection or sizing of the scissor mechanisms and/or via selective placement of inner and outer stop members permits the heights of the lift members where they are set and locked to be varied to provide the desired or appropriate or selected height of the respective deck portions for each of the deck sections (particularly for a shallower sloped configuration) depending on the particular application and desired configuration of the bleacher seating system.

Optionally, some of lift mechanisms 18 may be capable of only one predetermined locked height above the stowed or fully-lowered configuration, where the stowed or fully-lowered configuration serves as one seating height and a single elevated height serves as a second seating height above the first. For example, and with reference to FIG. 1B in which the bleacher seating system 10 is in a hockey-viewing or steeper-slope configuration, each forward deck portion 46*a-d* is in its fully-lowered configuration, and each rearward deck portion 48*a-d* is in a first raised configuration. Thus, the lift mechanisms corresponding to forward deck portions 46*a-d* may be raisable to and lockable at only one predetermined elevated height above the fully-lowered configuration (as in FIG. 1A) while still permitting the rows of bleacher seating system 10 to be configured in one of two differently-sloped configurations (where the fully lowered position provides the lower, mechanically-supported position or orientation and limits downward movement or lowering of the respective deck at that position). It will be appreciated that the lock mechanisms corresponding to forward deck portions 46*a-d* need only be deployed or locked in the elevated configuration of FIG. 1A, and may remain undeployed in the fully-lowered configuration as the scissor mechanisms rest substantially horizontally atop the crossbars 64 of support frames 58. Thus, and as can be seen with reference to FIGS. 1A and 1B, the rearward or elevated lift mechanisms of each deck portion or section may be raised to and locked at two (or more) different heights above the fully lowered or stowed orientation, while the forward lift mechanisms may be raised to and locked at one height for the shallower slope configuration (FIG. 1A) and may be fully lowered to their stowed positions or orientations for the steeper slope configuration (FIG. 1B). Accordingly, each lift mechanism 18 is capable of positioning and locking its corresponding deck portion 46*a-d*, 48*a-d* at one or more predetermined heights above the fully-lowered configuration, while some of the lift mechanisms are configured to or operable to position and lock their corresponding deck portions at two or more predetermined heights above the fully-lowered configuration.

Figure 10D:
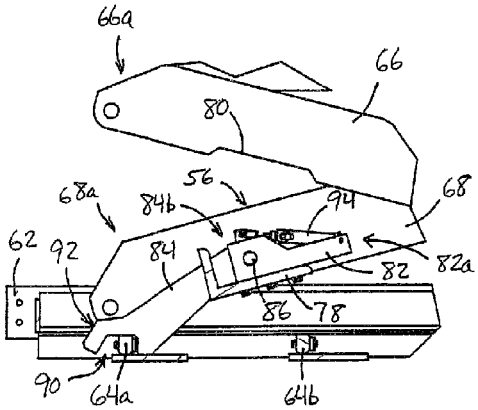
Figure 10E:
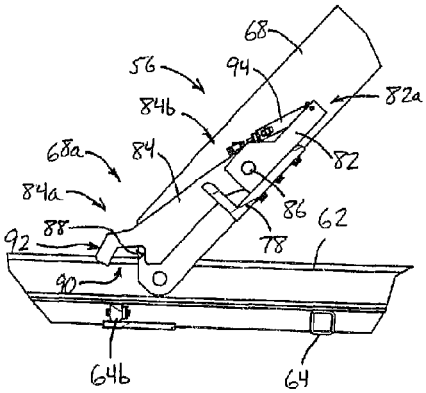
Figure 10F:
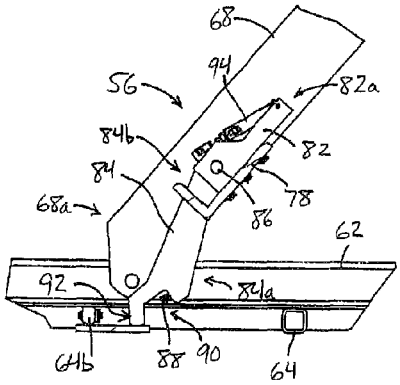
Figure 10G:
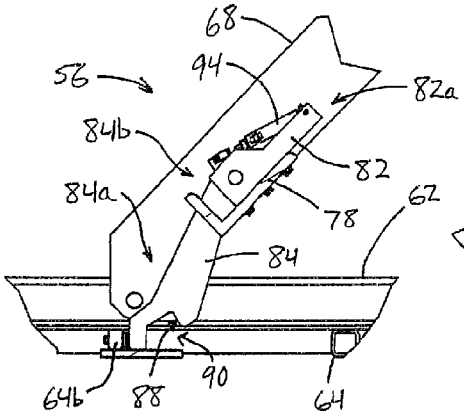
Figure 11G:
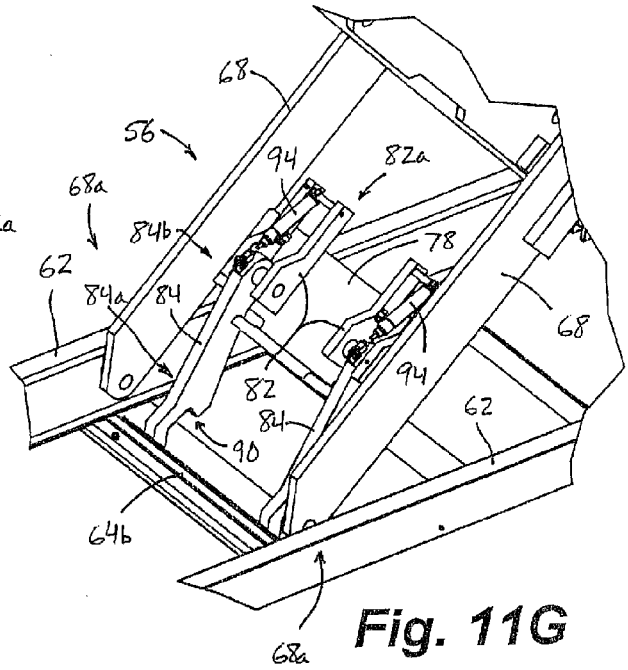

Bracket 78 limits or prevents lock members 84 of left scissor mechanism 54*a* from pivoting counterclockwise (as shown in FIGS. 10A-11G) beyond the orientation shown in FIGS. 10E-G and 11F-G, so that lock mechanisms 56 remain in the locking configuration when either of first and second bumper stop surfaces 88, 92 are contacting first or second stop members 64*a*, 64*b*, independent of the operation of actuator 94. It will be appreciated that lock members 84 are in substantially the same pivotal position relative to bracket 78 whether the lock members 84 are engaging the first stop member 64*a* (FIGS. 10D and 11D) or the second stop member 64B (FIGS. 10G and 11G).

Optionally, a controller 98 (FIG. 7) may be provided to control the extension and retraction of telescopic framework 12, and also to control the heights of the individual seating rows 16. Controller 98 may be wired directly to power/control base station 30 or, optionally, may be capable of wireless communication with the power/control base station 30, and may be located at the seating system or remote from the seating system, depending on the particular application. Controller 98 may be programmed to configure and lock the bleacher seating system 10 in a desired configuration automatically upon selection of the desired configuration by a user, and based upon the current or starting configuration. Controller 98 may comprise a programmable logic controller (PLC) that actuates or energizes powered drive systems 34, scissor mechanisms 54*a*, 54*b*, and lock mechanisms 56 in a particular order or sequence to achieve the desired result selected at the remote controller 98, such as will be described below.

Accordingly, the bleacher seating system 10 may be extended, retracted, and have its seating rows 16 raised and lowered to a desired configuration in response to a user input at controller 98. For example, frame sections 14*a-d* may be extended to one of the configurations shown in FIGS. 1A-D, 2, 4 and 5 by extending the frame sections from their fully collapsed or retracted configuration of FIGS. 5A and 6B. From the fully retracted configuration, frame sections 14*b-d* are extended together (by drive systems 34) outwardly away from frame section 14*a* (FIG. 6) until pivoting lock 40*b* engages to prevent frame section 14*b* from extending further. Once frame section 14*b* is locked in position, frame sections 14*c-d* extend together away from frame section 14*b* until pivoting lock 40*c* engages to prevent further extension of frame section 14*c* away from frame section 14*b* (FIG. 7). Powered drive system 34 may continue to drive driven wheels 36 to extend frame section 14*d* away from frame section 14*c* until pivoting lock 40*d* engages to prevent further extension of frame section 14*d* (FIGS. 1A-D). With seating rows 16 in their stowed or lowered positions, the extension process may be reversed to retract the frame sections 14*b-d*, such as, for example, beginning with frame section 14*d* retracting into or under frame section 14*c*, frame sections 14*c-d* retracting into or under frame section 14*b*, and so on until each of frame sections 14*b-d* is nested underneath or within frame section 14*a*.

With frame sections 14*a-d* in their fully extended configuration (FIGS. 1A-D, 2, 4 and 5), each seating row 16 may be raised to a respective desired height to achieve a desired configuration or slope of the seating system according to the type of event being viewed by spectators positioned and supported on the bleacher seating system. For example, in an arena or other indoor venue in which both basketball and hockey are played, it may be desirable to configure the seating rows 16 in a relatively steep slope (i.e. relatively large elevational change between each seating row) for viewing hockey (FIGS. 1B and 1D), while it may be desirable to configure the seating rows in a relatively shallow slope (i.e. small elevational change between individual seating rows) for viewing basketball (FIGS. 1A and 1C). In the basketball-viewing configuration of FIGS. 1A and 1C, the slope or elevational change between each seating row may be between about four and eight inches, while in the hockey-viewing configuration of FIGS. 1B and 1D, the slope or elevational change between each seating row may be between about twelve and sixteen inches. Optionally, in the basketball-viewing configuration of FIGS. 1A and 1C, it may be desirable to position another bleacher seating system in front of bleacher seating system 10 to provide additional seating rows along a generally continuous shallow slope down to the support surface on which the seating systems are positioned.

To achieve a collapsed or fully lowered or stowed position of seating rows 16 (FIGS. 8A, 9A, 10A, 11A), a shallow-slope locked configuration of the seating rows (FIGS. 8C, 9C, 10C, 11C), and a steeper-slope locked configuration of the seating rows (FIGS. 8G, 9G, 10G, 11C), scissor mechanisms 54*a*, 54*b* and lock mechanisms 56 proceed through a sequence of raising, lowering, locking, and unlocking to achieve safety and stability in each of the raised configurations, and compactness in the stowed configuration. Beginning with the fully lowered or stowed configuration of FIGS. 8A, 9A, 10A and 11A, first pivotable cross members 66 and second pivotable cross members 68 lie adjacent and substantially parallel to one another so that the deck frame 60 lies in close proximity (or in a nesting arrangement) relative to support frame 58, while lock member 84 of lock mechanism 56 is in an unlocking configuration with actuator 94 retracted.

To configure lift mechanism 18 at a first or shallow-slope locked height or configuration, hydraulic actuator 96 of lift mechanism 18 is pressurized to cause the first and second pivotable cross members 66, 68 to pivot relative to one another and begin to pivot upwards, with the respective outboard end portions 66*a*, 68*a* of first and second pivotable cross members 66, 68 translating inwardly or inboard along deck frame 60 and support frame 58, respectively (FIGS. 8B, 9B, 10B, 11B). Once left and right scissor mechanisms 54*a*, 54*b* have been pivoted or raised sufficiently so that deck frame 60 is at least slightly above its first or shallow-slope position (which may be different heights for the lift mechanisms of different sections), the actuation of hydraulic actuator 96 is stopped to hold deck frame 60 substantially stationary, and pneumatic actuators 94 of lock mechanism 56 are extended to pivot lock members 84 into their locking orientations, which positions first stop member 64*a* of support frame 58 inside of the recess 90 at distal end portion 84*a* of lock member 84 (FIGS. 8C, 9C, 10C, 11C). Hydraulic actuator 96 may then be retracted slightly to permit deck frame 60 to be lowered slightly until first stop member 64*a* is contacted by first bumper stop surface 88 of lock member 84 (FIGS. 8D, 9D, 10D, 11D). In this first or shallow-slope configuration, lock member 84 cannot be inadvertently moved to the unlocking position without first raising deck frame 60 because of the force applied to first bumper stop surface 88 of lock member 84 by first stop member 64*a*. Thus, in its first locked position, each seating row 16 is stabilized by lock mechanisms 56 on that row's respective scissor mechanisms 54*a*, 54*b*. Thus, the seating system is mechanically locked in its selected configuration, such that the seating system will not lower even if there is a decrease in pressure in actuators 96, such that locking mechanism 56 provides enhanced safety of the seating system and prevents unintentional lowering of the seating system.

To reposition deck frame 60 at its second or steeper-slope configuration from the first or shallow-slope configuration of FIGS. 8D, 9D, 10D and 11D, hydraulic actuators 96 are once again extended to raise left and right scissor mechanisms 54*a*, 54*b*. When the scissor mechanism is raised a sufficient amount to reduce or remove the force at the first bumper stop surface 88 of lock member 84, lock members 84 are pivoted to their unlocking configuration (FIGS. 8E, 9E, 10E, 11E). It will be appreciated that lock members 84 may not be repositioned at their unlocking positions prior to raising of the left and right scissor mechanisms 54*a*, 54*b* because the raising motion of the scissor mechanisms may move the lock members relative to the first stop members 64*a* upon raising of the lock members with outboard end portion 68*a* of second pivotable cross members 68 (optionally, the actuators 94 may be deactuated or depressurized to allow for substantially free pivotal movement of lock members 84, such as if the outer portion of the recess 90 contacts the stop member 64*a* as the lift mechanism raises the seating section further). In the illustrated embodiment, actuators 94 are retracted to pivot lock members 84 to their unlocking positions prior to reaching the second raised or steep-slope configuration of the lift mechanisms to prevent interference with second stop member 64*b* during operation of scissor mechanisms 54*a*, 54*b*, as will now be described.

To achieve the locked second or steeper-slope configuration, deck frame 60 is initially raised at least slightly above the steeper-slope configuration (FIGS. 8E, 9E, 10E, 11E) so that lock members 84 may be pivoted to their locking configuration by actuator 94 without interference with the second or inner stop member 64*b* (FIGS. 8F, 9F, 10F, 11F). With lock members 84 in their locking configuration, hydraulic actuator 96 may be retracted slightly to lower the scissor mechanisms 54*a*, 54*b* slightly until the second bumper stop surface 92 at distal end portion 84*a* of lock member 84 contacts second stop member 64*b* of support frame 58 (FIGS. 8G, 9G, 10G, 11G). Similar to the first or shallow-slope configuration of FIGS. 8C, 9C, 10C and 11C, scissor mechanisms 54*a*, 54*b* are prevented from lowering deck frame 60 below the steeper-slope configuration because of the contact between second bumper stop surface 92 and second stop member 64*b*. This contact prevents inadvertent unlocking of lock member 84, which in turn prevents uncommanded or unintentional lowering of the deck frame 60.

To lower the lift mechanisms 18 from either the first or shallow-slope configuration or the second or steeper-slope configuration, the raising process described above is performed in reverse, by first raising the scissor mechanisms 54*a*, 54*b* slightly to permit lock members 84 to be pivoted to their unlocking positions (such as via retraction of actuators 94), after which left and right scissor mechanisms 54*a*, 54*b* may be lowered to any desired height. Lock members 84 are left in their unlocking position if deck frame 60 is being lowered to the storage configuration. To set and lock the scissor mechanisms in the first or shallow-slope configuration from the second or steeper-slope configuration, the downward progress of left and right scissor mechanisms 54*a*, 54*b* is halted prior to reaching the first or shallow-slope configuration so that lock members 84 can be lowered (such as via extension of actuators 94) to their locking configurations before the final lowering of the scissor mechanisms to engage first bumper stop surfaces 88 of lock members 84 with first stop members 64*a*. Clearly, the lift mechanisms of the outer sections 14*b-d* would operate in a similar manner, but their inner and outer stop members would be positioned further inboard, relative to stop members 64*a*, 64*b*, to provide or correspond to increasingly greater heights, depending on the section at which the lift mechanism is disposed and the desired or appropriate or selected height at which the deck portion is to be set.

It will be appreciated that by programming the controller 98 to perform a specific actuation sequence of hydraulic actuators 96 and pneumatic actuators 94 according to the desired configuration of the individual seating rows 16, an operator's task may be simplified to require, for example, simply selecting the desired seating configuration using a button or touch screen or other user input to instruct the controller 98 to command the appropriate actuation sequence to reach the desired configuration based on the current configuration (whereby the system is automatically adjusted and controlled in the manner described above). Optionally, an operator may be required to hold a button or other signal device on controller 98 throughout operation of the lift mechanisms 18 and/or the drive systems 34 to provide a safety feature so that the lift mechanism 18 may be readily halted simply by releasing the button or signal device upon detection of any unsafe condition.

Thus, the bleacher seating system of the present invention provides a compact, automatically extending and retracting set of seating rows that may be configured at one of two or more different heights or slopes so that the seating is adaptable to different events or needs that call for different configurations of seating. The bleacher seating system may be extended, retracted, raised, and lowered by a single operator, and may be set between various heights or slopes of seating, or retracted fully or partially against or into a wall or other storage area, in a relatively short period of time, which reduces facility costs and facility changeover times, such as may be necessary for facilities that host different types of events. The bleacher seating system may be locked or mechanically secured in each of the predetermined or selected heights via a locking device or mechanism to provide enhanced safety for the seating system.

Changes and modifications to the specifically described embodiments may be carried out without departing from the principles of the present invention, which is intended to be limited only by the scope of the appended claims as being interpreted according to the principles of patent law including the doctrine of equivalents.

The invention claimed is:

1. A bleacher seating system comprising:

a plurality of deck portions, each of said deck portions configured to support one or more seats, said deck portions being movable relative to one another between a nested configuration in which said deck portions are arranged generally on top of one another, and an extended position in which a lower deck portion is extended outward from an upper deck portion so that the deck portions are arranged in a stepped manner;

a lift mechanism for adjustably supporting a respective one of said deck portions at a support surface, wherein said lift mechanism is configured to selectively raise and lower said respective deck portion between a lowered position, a first raised position and a second raised position relative to the support surface;

first and second stop members coupled to said lift mechanism;

a lock mechanism for limiting lowering of a respective one of said deck portions when said respective deck portion is at one of said first and second raised positions, said lock mechanism comprising:

a lock member having a proximal end portion that is pivotally coupled to said lift mechanism and pivotable between a locking position and an unlocking position, and a distal end portion configured to engage said stop members, said distal end portion of said lock member comprising (i) a first stop surface configured to selectively engage said first stop member when said respective deck portion is in said first raised position and said lock member is in said locking position, and (ii) a second stop surface that is spaced from said first stop surface and is configured to selectively engage said second stop member when said respective deck portion is in said second raised position and said lock member is in said locking position; and an actuator coupled between said lock member and said lift mechanism, wherein said actuator is operable to selectively pivot said lock member between said locking position and said unlocking position;

wherein said lock mechanism is actuatable to mechanically limit or substantially preclude lowering of said deck portion responsive to said deck portion being moved to one of said first and second raised positions.

2. The bleacher seating system of claim 1, wherein said lift mechanism comprises a first lift mechanism for adjustably supporting a first of said deck portions at a support surface, wherein said first lift mechanism is configured to selectively raise and lower said first deck portion between a first position and a second position relative to the support surface, and a second lift mechanism for adjustably supporting a second of said deck portions at the support surface, wherein said second lift mechanism is configured to selectively raise and lower said second deck portion between a first position and a second position relative to the support surface, independent of said first lift mechanism.

3. The bleacher seating system of claim 2, wherein said lock mechanism comprises a first lock mechanism for limiting lowering of said first deck portion when said first deck portion is at one of said first and second raised positions, and a second lock mechanism for limiting lowering of said second deck portion when said second deck portion is at one of said first and second raised positions, wherein said second lock mechanism is actuatable independently of said first lock mechanism.

4. The bleacher seating system of claim 3, wherein when said lock member of said first lock mechanism is in said unlocking position, said first deck portion is lowerable from either of said first and second raised positions by said first lift mechanism.

5. The bleacher seating system of claim 1, wherein said lock member is movable from said locking position to said unlocking position only when neither of said first and second stop surfaces is contacting said stop members.

6. The bleacher seating system of claim 1, wherein said lift mechanism comprises a scissor mechanism.

7. The bleacher seating system of claim 6, further comprising a support frame positioned generally below said deck frame, wherein said scissor mechanism comprises first and second lift elements pivotally coupled to one another at their respective midsections, wherein said first lift element comprises a lower end portion pivotally coupled to said support frame and an upper end portion slidably coupled to said deck frame, said second lift element comprises a lower end portion slidably coupled to said support frame and an upper end portion pivotally coupled to said deck frame.

8. The bleacher seating system of claim 7, wherein said proximal end portion of said lock member is pivotally coupled to said second lift element near said lower end portion thereof, and wherein said stop members are coupled to said support frame in spaced arrangement.

9. The bleacher seating system of claim 7, wherein said lift mechanism comprises a pair of said scissor mechanisms arranged parallel to one another in fore/aft spaced arrangement.

10. The bleacher seating system of claim 7, wherein said lift mechanism comprises a pair of said scissor mechanisms arranged in side-by-side and coplanar spaced arrangement.

11. The bleacher seating system of claim 10, wherein said lift mechanism comprises a second pair of said scissor mechanisms arranged in fore/aft spaced arrangement relative to the first pair of said scissor mechanisms.

12. The bleacher seating system of claim 4, wherein said lift mechanism comprises a deck frame and a support frame, said deck frame coupled to a first of said plurality of deck portions and supporting said first deck portion, said support frame positioned generally below said deck frame, and wherein said lift mechanism is configured to selectively raise and lower said first deck portion and said deck frame relative to said support frame.

13. The bleacher seating system of claim 12, further comprising a base frame supported at the support surface, wherein said support frame is supported in a substantially fixed spaced arrangement above said base frame by at least one support member.

14. The bleacher seating system of claim 13, wherein said at least one support member comprises a substantially vertical beam and a substantially horizontal beam projecting from an upper end portion of said vertical beam in a cantilever fashion, wherein said support frame is supported at said horizontal beam.

15. The bleacher seating system of claim 12, wherein said support frame comprises a pair of generally parallel support frame members and first and second stop members comprise respective cross members spanning between said support frame members, each of said stop members corresponding to a respective one of said first and second positions of said deck frame, said first and second raised positions corresponding to first and second redetermined heights of said deck frame.

16. The bleacher seating system of claim 1, further comprising a controller configured to automatically control the actuation of said lift mechanisms and said lock mechanisms.

17. The bleacher seating system of claim 16, wherein said controller is configured to automatically position and lock each of said lift mechanisms at either of said first and second raised positions in response to a single user input at said controller.

18. The bleacher seating system of claim 1, wherein each of said first and second raised positions comprises a respective raised position above a fully-lowered position.

19. The bleacher seating system of claim 1, wherein said lift mechanism comprises a hydraulic actuator and said actuator of said lock mechanism comprises a pneumatic actuator.

20. A bleacher seating system comprising:

at least two deck portions, said at least two deck portions positioned adjacent one another with a first of said at least two deck portions positioned in front of a second of said at least two deck portions, said at least two deck portions each configured to support one or more seats;

at least two deck frames, said at least two deck frames coupled to respective ones of said at least two deck portions and supporting said at least two deck portions;

at least two support frames, said at least two support frames positioned generally below respective ones of said at least two deck frames;

at least two lift mechanisms, said at least two lift mechanisms coupled between respective ones of said at least two support frames and said at least two deck frames, and configured to selectively raise and lower corresponding ones of said first and second deck portions relative to respective ones of said at least two support frames;

wherein said first of said at least two deck portions is positioned at an elevation below said support frame corresponding to said second of said at least two deck portions;

first and second stop members coupled to each of said lift mechanisms;

a lock mechanism for limiting lowering of a respective one of said deck portions when said respective deck portion is at a raised position, said lock mechanism comprising:

a lock member having a proximal end portion that is pivotally coupled to said lift mechanism and pivotable between a locking position and an unlocking position, and a distal end portion configured to selectively engage said stop members, said distal end portion of said lock member comprising a first stop surface configured to selectively engage said first stop member when said respective deck portion is in a first raised position and said lock member is in said locking position, and a second stop surface that is spaced from said first stop surface and is configured to selectively engage said second stop member when said respective deck portion is in a second raised position and said lock member is in said locking position; and an actuator coupled between said lock member and said lift mechanism, wherein said actuator is operable to selectively pivot said lock member between said locking position and said unlocking position;

wherein said lock mechanism is operable to mechanically limit or substantially preclude lowering of said deck portion responsive to said deck portion being moved to one of said first and second raised positions.

21. The bleacher seating system of claim 20, further comprising at least two base frames supported at a generally horizontal support surface, wherein said at least two support frames are supported in a substantially fixed spaced arrangement above respective ones of said at least two base frames by respective support members.

22. The bleacher seating system of claim 21, further comprising an extension/retraction system at at least one of said at least two base frames, wherein said extension/retraction system is configured to move at least one of said base frames outwardly away from the other of said base frames and along the support surface.

23. The bleacher seating system of claim 22, further comprising a controller configured to selectively control the actuation of said lift mechanisms and to control the actuation of said extension/retraction system.

24. The bleacher seating system of claim 20, wherein said lift mechanisms comprise scissor mechanisms having first and second lift elements pivotally coupled to one another at their respective midsections, wherein said first lift element comprises a lower end portion pivotally coupled to a respective one of said support frames and an upper end portion slidably coupled to said a respective one of said deck frames, said second lift element comprising a lower end portion slidably coupled to the other of said support frames and an upper end portion pivotally coupled to the other of said deck frames.

25. The bleacher seating system of claim 24, wherein said lift mechanisms each comprise respective ones of said lock mechanisms.

26. The bleacher seating system of claim 20, further comprising a pair of said deck portions, a pair of said deck frames, and a pair of said lift mechanisms at said support frame, wherein each of said pair of lift mechanisms is independently actuatable.

27. A method of extending and retracting a telescopic bleacher seating system, said method comprising:

providing at least two rows of seating areas, each of said rows comprising a deck portion, a support frame, a lift mechanism coupled between said deck portion and said support frame, a base frame spaced below said support frame, a stop member coupled to said base frame, and a support member coupled between said base frame and said support frame, wherein a first of said at least two rows of seating areas is positioned substantially directly below the support frame of a second of said at least two rows of seating areas when said seating areas are in a retracted configuration;

extending said seating system by positioning said first of said at least two rows of seating areas in front of said second of said at least two rows of seating areas;

actuating each of said lift mechanisms of said at least two rows of seating areas to raise said deck portions to a desired one of at least two selectable respective heights;

actuating lock mechanisms of each of said lift mechanisms into a locking configuration in which a stop surface of said locking mechanisms is configured to contact said stop member at said base frame to prevent movement of said deck portions below said desired one of said at least two selectable respective heights;

actuating said lock mechanisms of each of said lift mechanisms into an unlocked configuration in which said stop surface of said locking mechanism is configured to not contact said stop member as said stop surface moves past said stop member;

actuating each of said lift mechanisms of said at least two rows of seating areas to lower said deck portions at least until the deck portion of the first of said at least two rows of seating areas is positioned at an elevation below the support frame of the second of said at least two rows of seating areas; and retracting said seating system by positioning said first of said at least two rows of seating areas below the support frame of said second of said at least two rows of seating areas.

28. The method of claim 27, further comprising:

providing an extension/retraction system at said base frame;

wherein said positioning said first of said at least two rows of seating areas in front of said second of said at least two rows of seating areas comprises actuating said extension/retraction system to drive said first of said at least two rows of seating areas along a support surface and away from said second of said at least two rows of seating areas; and wherein said positioning said first of said at least two rows of seating areas directly below said support frame of said second of said at least two rows of seating areas comprises actuating said extension/retraction system to drive said first of said at least two rows of seating areas along the support surface and toward said second of said at least two rows of seating areas.

29. The method of claim 27, wherein said actuating each of said lift mechanisms to raise said deck portions comprises initially raising said deck portions above said desired one of at least two selectable respective heights before actuating said lock mechanisms into the locking configuration, and then lowering said deck portions to said desired one of said at least two selectable respective heights.

30. The method of claim 29, wherein said actuating said lock mechanisms into said unlocked configuration is accomplished after first actuating said lift mechanisms to raise said deck portions at least slightly above said desired one of said at least two selectable respective heights.

31. The method of claim 27, further comprising:

actuating each of said lift mechanisms of said at least two rows of seating areas to raise or lower said deck portions to an other of said at least two selectable respective heights after said actuating said lock mechanisms into said unlocked configuration; and actuating said lock mechanisms of said lift mechanisms into said locking configuration to prevent movement of said deck portions below said other of said at least two respective heights prior to said lowering said deck portions at least until said deck portion of said first of said at least two rows of seating areas is positioned at an elevation below said support frame of said second of said at least two rows of seating areas.

32. The method of claim 27, further comprising:

providing a controller; and automatically controlling at least two chosen from (i) said extending said seating system, (ii) said actuating each of said lift mechanisms, and (iii) said actuating said lock mechanisms in a sequenced manner, via said controller.

33. The method of claim 32, further comprising entering a single user input at said controller to automatically position and lock each of said lift mechanisms at any of said at least two selectable heights.

34. The method of claim 33, further comprising entering a second user input at said controller to fully extend or retract said at least two rows of seating areas.

* * * * *

UNITED STATES PATENT AND TRADEMARK OFFICE

CERTIFICATE OF CORRECTION

PATENT NO. : 8,407,943 B2
APPLICATION NO. : 12/913207
DATED : April 2, 2013
INVENTOR(S) : Joe B. Sudkamp et al.

It is certified that error appears in the above-identified patent and that said Letters Patent is hereby corrected as shown below:

In the Specification

Column 9:
Line 6, "10E-G" should be --10F-G--

Column 10:
Line 26, "10E-G" should be --10F-G--

Column 12:
Line 18, "10E-G" should be --10F-G--

In the Claims

Column 17:
Line 49, Claim 15, "redetermined" should be --predetermined--

Signed and Sealed this
Fourth Day of March, 2014

Michelle K. Lee

Michelle K. Lee
*Deputy Director of the United States Patent and Trademark Office*